US007049055B2

(12) United States Patent
Yanagi et al.

(10) Patent No.: US 7,049,055 B2
(45) Date of Patent: May 23, 2006

(54) SILVER HALIDE PHOTOGRAPHIC MATERIAL

(75) Inventors: Terukazu Yanagi, Kanagawa (JP); Katsuhiko Kanazawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 78 days.

(21) Appl. No.: 10/864,539

(22) Filed: Jun. 10, 2004

(65) Prior Publication Data

US 2005/0221239 A1 Oct. 6, 2005

(30) Foreign Application Priority Data

Jun. 11, 2003 (JP) ..... 2003-166617

(51) Int. Cl.
*G03C 1/85* (2006.01)
*G03C 1/05* (2006.01)
*G03C 1/494* (2006.01)

(52) U.S. Cl. ..... 430/527; 430/546; 430/631; 430/637; 430/502

(58) Field of Classification Search ..... 430/502, 430/527, 546, 631, 637
See application file for complete search history.

(56) References Cited

U.S. PATENT DOCUMENTS 4,891,307 A 1/1990 Mukunoki et al.
5,571,665 A 11/1996 Ballerini et al.

FOREIGN PATENT DOCUMENTS

JP 61-47948 A 3/1986
JP 62-109044 A 5/1987
JP 7-159929 A 6/1995

*Primary Examiner*—Geraldine Letscher
(74) *Attorney, Agent, or Firm*—Birch, Stewart, Kolasch & Birch, LLP

(57) ABSTRACT

Disclosed is a silver halide photographic material containing a non ionic fluorine compound of formula (1) and an anionic fluorine compound of formula (2). The silver halide photographic material has good static resistance and excellent anti static properties.

(1): $C_4F_9$—$CH_2CH(OH)CH_2$—$(OCH_2CH_2)_m$—$OC_nH_{2n+1}$
wherein m is 15–40; n is 8–24;
(2):

wherein $R^{11}$–$R^{13}$ are H or substitutent; n1 and n2 are 4–8; $L^{11}$ and $L^{12}$ are alkylene, alkyleneoxy, or linking group; m11 is 0–1; $M^1$ is cation.

20 Claims, No Drawings

SILVER HALIDE PHOTOGRAPHIC MATERIAL

This Nonprovisional application claims priority under 35 U.S.C. § 119(a) on Patent Application No(s) 2003-166617 filed in JAPAN on Jun. 11, 2003, the entire contents of which are hereby incorporated by reference.

BACKGROUND OF THE INVENTION

1. Field of the Invention

The present invention relates to a silver halide photographic material that has good static resistance and good anti static properties.

2. Description of the Background

Heretofore, fluoroalkyl chain-having compounds are known as surfactants. Such surfactants enable various surface modifications owing to the properties (water-repellent, oil-repellent, lubricative, anti static properties) peculiar to the fluoroalkyl chain therein, and are used for surface treatment of various substrates such as fibers, fabrics, carpets, resins, etc. When such a fluoroalkyl chain-having surfactant (hereinafter referred to as "fluorine-containing surfactant") is added to an aqueous medium solution of a different type of base material, then the resulting solution may form a uniform coating film with no repellency in forming the film and, in addition, an adsorbent layer of the surfactant may be formed on the surface of the base material and the surface of the coating film may therefore have the peculiar properties of the fluoroalkyl chain of the surfactant.

Various surfactants are used in photographic materials, and they have important functions therein. In general, photographic materials are produced by applying multiple coating liquids that contain an aqueous solution of hydrophilic colloid binder (e.g., gelatin), onto a support to form multiple layers thereon. Multiple hydrophilic colloid layers are often formed all a time in a mode of simultaneous formation of multiple layers. These layers include anti static layer, subbing layer, antihalation layer, silver halide emulsion layer, interlayer, filter layer and protective layer, and various materials are added to each layer for exhibiting their functions. Polymer latex may be added to hydrophilic colloid layers for improving the physical film properties of the layers. In order to add hardly water-soluble functional compounds such as color coupler, UV absorbent, fluorescent brightener and lubricant, to hydrophilic colloid layers, they are, either directly or after dissolved in a high-boiling-point organic solvent such as phosphate or phthalate, emulsified and dispersed in a hydrophilic colloid solution and used in preparing coating liquids for them. In that manner, photographic materials generally comprise various hydrophilic colloid layers. In producing them, it is desired that the coating liquids containing various materials are uniformly and rapidly applied onto supports with no coating failure such as coating repellency or coating unevenness. To satisfy the requirement, surfactant that serves as a coating aid is often added to the coating liquids.

On the other hand, photographic materials are kept in contact with various substances while they are produced, exposed for image formation thereon, and processed for development. For example, when photographic materials are kept rolled up until they are processed, then the back layer formed on the back of the support may be kept in contact with the surface layer thereof. While conveyed and processed, they may be brought into contact with stainless or rubber rollers. When in contact with these materials, the surface (gelatin layer) of the photographic material may be positively charged and, as the case may be, it may undergo unnecessary discharging. As a result, the photographic material may have undesirable static marks. To reduce the chargeability of gelatin, a technique of static retardation (for reducing the quantity of charge) or a technique of accumulated charge leakage may be employed. For static retardation, fluorine-containing compounds are effective, and a fluorine-containing surfactant is often added to photographic materials.

For accumulated charge leakage, a polyethylene oxide-containing surfactant is often added to photographic materials so as to reduce the surface resistivity of the materials (e.g., JP-A 61-47948, claim 1). From the viewpoint of such static retardation and charge leakage, a hydrocarbon-type non ionic surfactant, a fluorine-containing non ionic surfactant and a fluorine-containing anionic surfactant are specifically balanced and combined, and the resulting combination is used in silver halide photographic materials, especially in those for X-ray exposure (X-ray photographic materials) for making the photographic materials resistant to static electrification (e.g., JP-A 62-109044, page 1 and JP-A 7-159929, page 1).

As so described hereinabove, surfactants, especially fluorine-containing surfactants are used as a coating aid for homogenizing coating films or as an agent that has two functions of homogenizing coating films and preventing static electrification of photographic materials.

However, these materials do not always have satisfactory properties enough for the recent requirement of high sensitivity and rapid processability of photographic materials, and it is desired to further improve fluorine-containing surfactants to that effect. Recently, it has been suggested that surfactants which are derived from perfluorooctanesulfonic acid obtained through electrolytic fluorination and which have heretofore been popularly used in the art may accumulate in bionomic systems to a considerable extent. Given that situation, it is desired to develop a surfactant not containing perfluorooctanesulfonic but having a fluoroalkyl group.

An object of the present invention is to provide a silver halide photographic material that contains a novel, short-chain fluoroalkyl group-having non ionic surfactant and has good static resistance and good anti static properties.

SUMMARY OF THE INVENTION

The means of the invention for solving the problems are as follows:

<1> A silver halide photographic material having, on a support thereof, one or more layers including a photosensitive silver halide emulsion layer, which contains at least one non ionic fluorine compound of the following formula (1) and at least one anionic fluorine compound of the following formula (2):

$$C_4F_9—CH_2CH(OH)CH_2—(OCH_2CH_2)_m—OC_nH_{2n+1} \quad (1)$$

wherein m indicates from 15 to 40; n indicates from 8 to 24; m and n each may be a single value or may be distributed, and when distributed, they each indicate their mean value, (2)

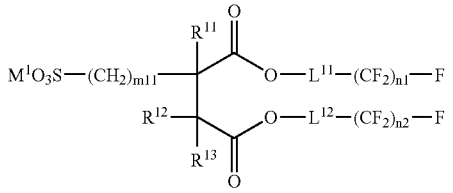

wherein $R^{11}$, $R^{12}$ and $R^{13}$ each independently represent a hydrogen atom or a substitute; n1 and n2 each independently indicate an integer of from 4 to 8; $L^{11}$ and $L^{12}$ each independently represent a substituted or unsubstituted alkylene group, a substituted or unsubstituted alkyleneoxy group, or a divalent linking group constructed by combining any of these; m11 indicates 0 or 1; $M^1$ represents a cation.

<2> The silver halide photographic material of <1>, which further contains at least one anionic hydrocarbon compound of the following formula (3):

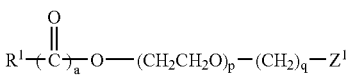

(3)

wherein $R^1$ represents an alkyl or alkenyl group having from 6 to 25 carbon atoms; q indicates from 2 to 4; p indicates from 0 to 30; p may be a single value or may be distributed, and when distributed, it indicates its mean value; a indicates 0 or 1; $Z^1$ represents $OSO_3M$ or $SO_3M$; M represents a cation.

<3> The silver halide photographic material of <1> or <2>, which has a non-photosensitive hydrophilic colloid layer as the outermost layer thereof, and in which the outermost layer contains at least one non ionic fluorine compound of formula (1) and at least one anionic fluorine compound of formula (2).

<4> The silver halide photographic material of <3>, which has a non-photosensitive hydrophilic colloid layer as the outermost layer thereof, and in which the outermost layer contains at least one non ionic fluorine compound of formula (1), at least one anionic fluorine compound of formula (2), and at least one anionic hydrocarbon compound of formula (3).

<5> The silver halide photographic material of any of <1> to <4>, which has a non-photosensitive hydrophilic colloid layer as the outermost layer on both sides of the support thereof, and in which at least one outermost layer contains at least one non ionic fluorine compound of formula (1), at least one anionic fluorine compound of formula (2), and at least one anionic hydrocarbon compound of formula (3).

<6> The silver halide photographic material of any of <1> to <4>, which has a non-photosensitive hydrophilic colloid layer as the outermost layer on both sides of the support thereof, and in which both outermost layers contain at least one non ionic fluorine compound of formula (1), at least one anionic fluorine compound of formula (2), and at least one anionic hydrocarbon compound of formula (3).

BEST MODE FOR CARRYING OUT THE INVENTION

The invention is described in detail hereinunder. In this description, the numerical range expressed by the wording "a number to another number" means the range that falls between the former number indicating the lowermost limit of the range and the latter number indicating the uppermost limit thereof.

The fluorine compound of formula (1) for use in the invention (this may be referred to as "compound (1) of the invention" or "non ionic fluorine compound of the invention") is described in detail.

$$C_4F_9—CH_2CH(OH)CH_2—(OCH_2CH_2)_m—OC_nH_{2n+1} \quad (1)$$

In this, m indicates from 15 to 40, and it may be a single value or may be distributed. When distributed, it indicates its mean value. m is preferably from 20 to 40.

n indicates from 8 to 24, and it may be a single value or may be distributed. When distributed, it indicates its mean value. n is preferably from 10 to 20, more preferably from 12 to 20, even more preferably from 12 to 18, still more preferably from 12 to 16.

Formula (1) is preferably the following formula (1-A):

$$C_4F_9—CH_2CH(OH)CH_2—(OCH_2CH_2)_{ma}—OC_{na}H_{2na+1} \quad (1\text{-A})$$

In this, ma indicates from 20 to 40, more preferably from 25 to 40. It may be a single value or may be distributed. When distributed, it indicates its mean value. na indicates from 12 to 18, preferably from 12 to 16. It may be a single value or may be distributed. When distributed, it indicates its mean value.

Examples of the compounds of formula (1) are mentioned below, which, however, should not at all restrict the scope of the invention.

FS-101: $C_4F_9—CH_2CH(OH)CH_2—(OCH_2CH_2)_{20}—OC_{18}H_{37}$

FS-102: $C_4F_9—CH_2CH(OH)CH_2—(OCH_2CH_2)_{21}—OC_{12}H_{25}$

FS-103: $C_4F_9—CH_2CH(OH)CH_2—(OCH_2CH_2)_{23}—OC_{16}H_{33}$

FS-104: $C_4F_9—CH_2CH(OH)CH_2—(OCH_2CH_2)_{25}—OC_{12}H_{25}$

FS-105: $C_4F_9—CH_2CH(OH)CH_2—(OCH_2CH_2)_{40}—OC_{16}H_{33}$

FS-106: $C_4F_9—CH_2CH(OH)CH_2—(OCH_2CH_2)_{32}—OC_{14}H_{29}$

The compounds of formula (1) may be produced, for example, according to the methods described in *Journal of Fluorine Chemistry,* 84 (1997), 53–61. Briefly, an epoxide compound having a substitute of a fluoroalkyl group is reacted with a hydroxyl group-having compound under heat in the presence of a Lewis acid to give various derivatives.

The compound of formula (2) (this may be referred to as "compound (2) of the invention" or "anionic fluorine compound of the invention") is described in detail.

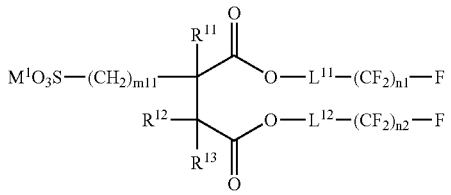

(2)

In this, $R^{11}$, $R^{12}$ and $R^{13}$ each independently represent a hydrogen atom or a substitute; n1 and n2 each independently indicate an integer of from 4 to 8; $L^{11}$ and $L^{12}$ each independently represent a substituted or unsubstituted alkylene group, a substituted or unsubstituted alkyleneoxy group, or a divalent linking group constructed by combining any of these; m11 indicates 0 or 1; $M^1$ represents a cation.

In formula (2), $R^{11}$, $R^{12}$ and $R^{13}$ each independently represent a hydrogen atom or a substitute. The substitute may be selected from the substitute group T mentioned hereinunder. Preferably, $R^{11}$, $R^{12}$ and $R^{13}$ each are an alkyl group or a hydrogen atom, more preferably an alkyl group having from 1 to 12 carbon atoms, or a hydrogen atom, even more preferably a methyl group or a hydrogen atom, still more preferably a hydrogen atom.

In formula (2), n1 and n2 each independently indicate an integer of from 4 to 8. Preferably, n1 and n2 each are an integer of from 4 to 6, and n1=n2; more preferably they are an integer of 4 or 6, and n1=n2; even more preferably n1=n2=4.

In formula (2), $m_{11}$ indicates 0 or 1, and any of these is preferred in the same manner.

In formula (2), $L^{11}$ and $L^{12}$ each independently represent a substituted or unsubstituted alkylene group, a substituted or unsubstituted alkyleneoxy group, or a divalent linking group constructed by combining any of these. The substitute may be selected from the substitute group T mentioned hereinunder.

Preferably, $L^{11}$ and $L^{12}$ each have at most 4 carbon atoms. Also preferably, they are an unsubstituted alkylene group.

$M^1$ represents a cation. Preferred examples of the cation for $M^1$ are an alkali metal ion (e.g., lithium ion, sodium ion, potassium ion), an alkaline earth metal ion (e.g., barium ion, calcium ion), and an ammonium ion. Of those, more preferred are lithium ion, sodium ion, potassium ion and ammonium ion.

Of the compounds of formula (2), preferred are those of the following formula (2-A):

(2-A)

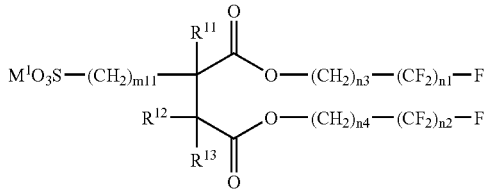

In formula (2-A), $R^{11}$, $R^{12}$, $R^{13}$, n1, n2, m11 and $M^1$ have the same meanings as those in formula (2), and their preferred ranges are also the same as therein. n3 and n4 each independently indicate an integer of from 1 to 6.

In formula (2-A), n3 and n4 each independently indicate an integer of from 1 to 6. Preferably, n3 and n4 each are an integer of from 1 to 6, and n3=n4; more preferably they are 2 or 3, and n3=n4; even more preferably n3=n4=2.

Of the compounds of formula (2), more preferred are those of the following formula (2-B):

(2-B)

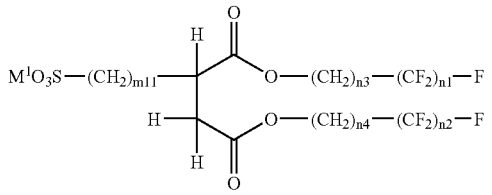

In formula (2-B), n1, n2, m11 and $M^1$ have the same meanings as those in formula (2), and their preferred ranges are also the same as therein. In formula (2-B), n3 and n4 have the same meanings as those in formula (2-A), and their preferred ranges are also the same as therein.

Of the compounds of formula (2), even more preferred are those of the following formula (2-C):

(2-C)

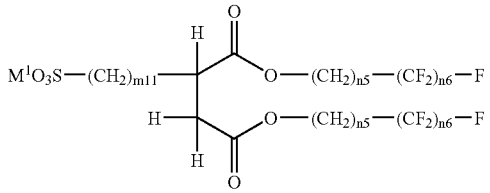

In formula (2-C), n5 indicates 2 or 3, preferably 2. n6 indicates an integer of from 4 to 6, preferably 4. m11 indicates 0 or 1, and any of these is preferred in the same manner. $M^1$ has the same meaning as that in formula (2), and its preferred range is also the same as therein.

Examples of formula (2) are described in detail hereinunder, which, however, should not at all restrict the scope of the invention.

FS-1

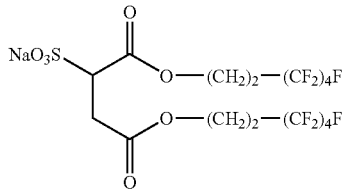

FS-7

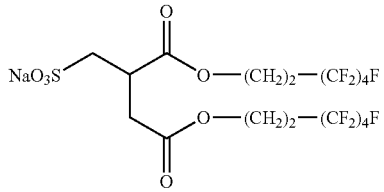

FS-2

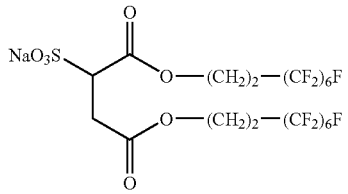

FS-8

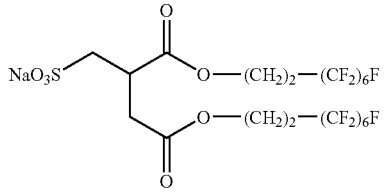

FS-3

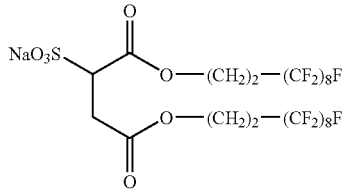

-continued
FS-9
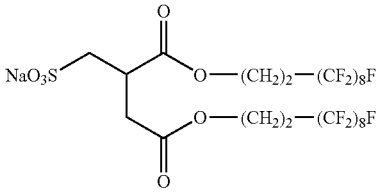
FS-4
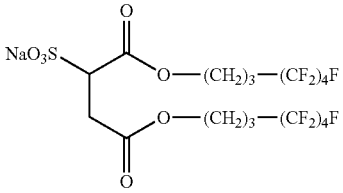
FS-10
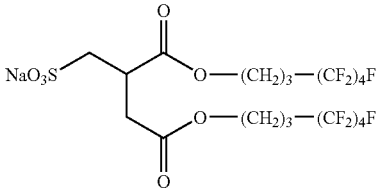
FS-5
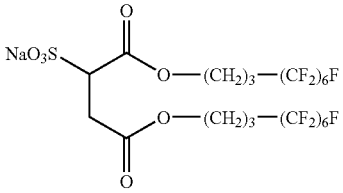
FS-11
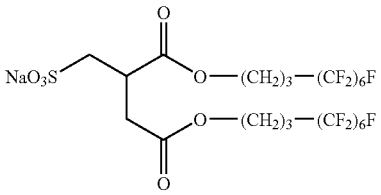
FS-6
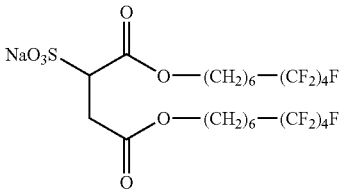
FS-12
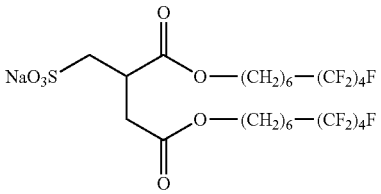
-continued
FS-13
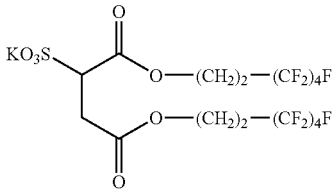
FS-19
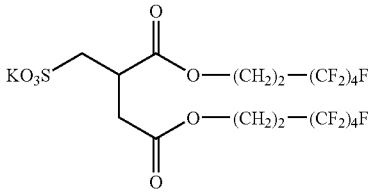
FS-14
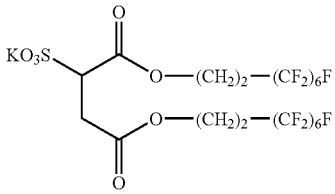
FS-20
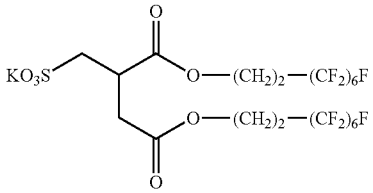
FS-15
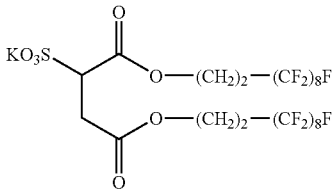
FS-21
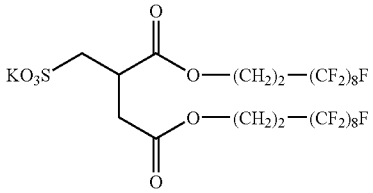
FS-16
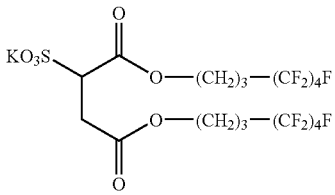
FS-22
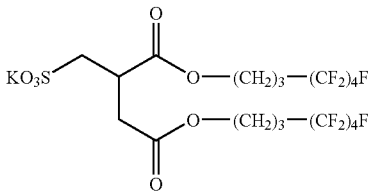

-continued
FS-17
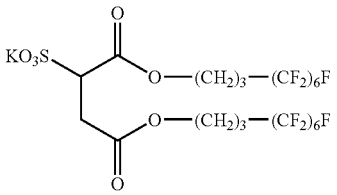
FS-23
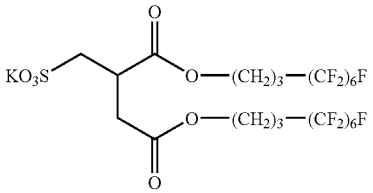
FS-18
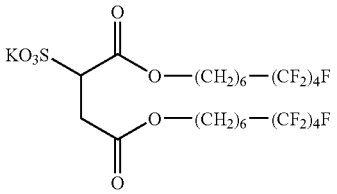
FS-24
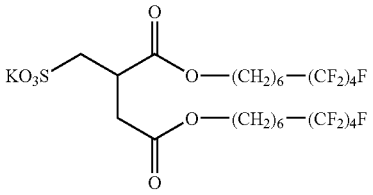
FS-24
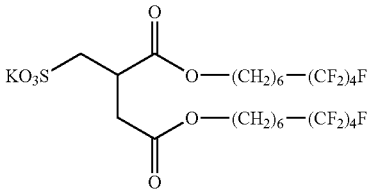
FS-25
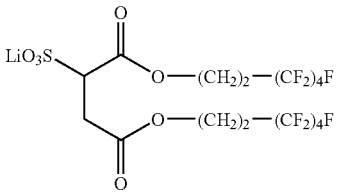
FS-31
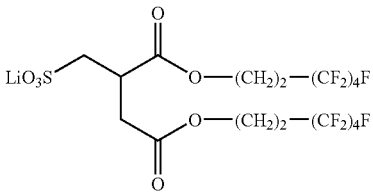
FS-26
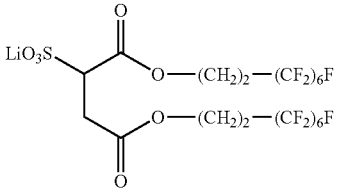
-continued
FS-32
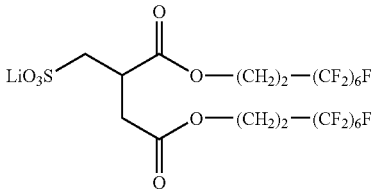
FS-27
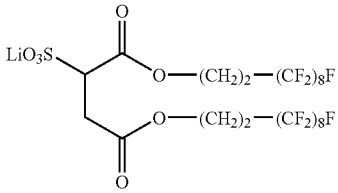
FS-33
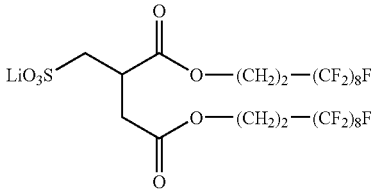
FS-28
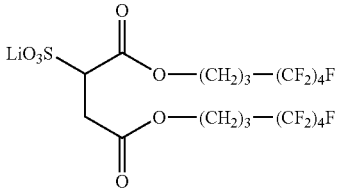
FS-34
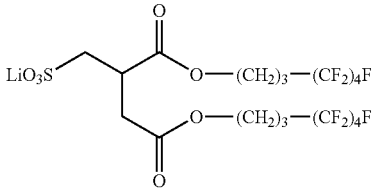
FS-29
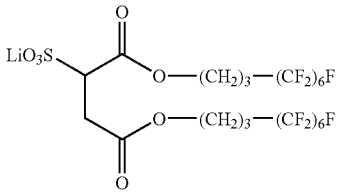
FS-35
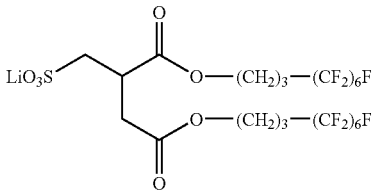
FS-30
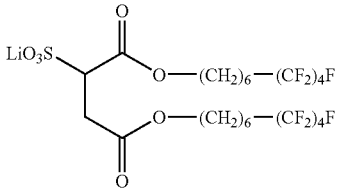

-continued

FS-36

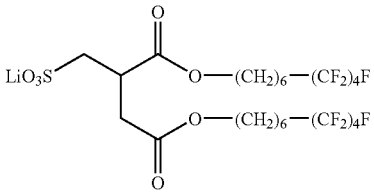

FS-37

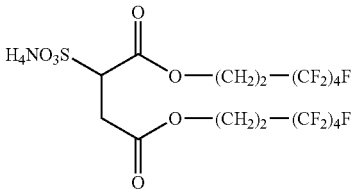

FS-40

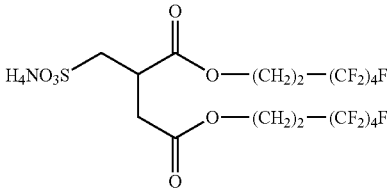

FS-38

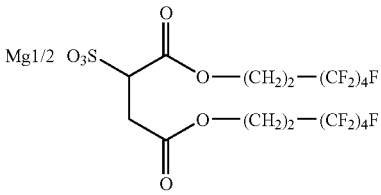

FS-41

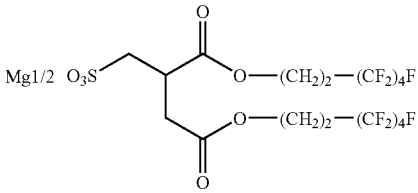

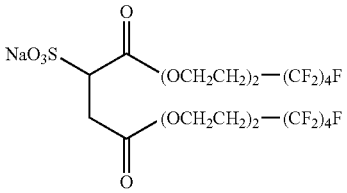

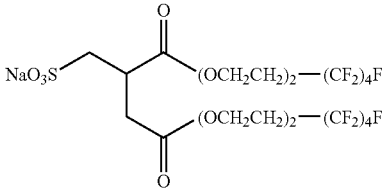

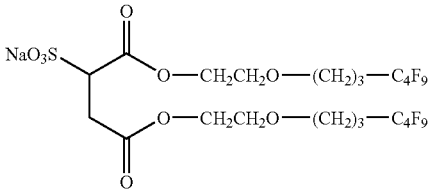

-continued

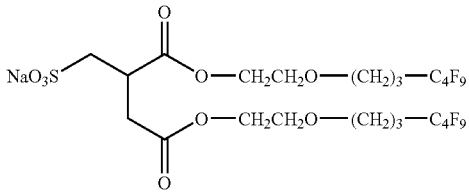

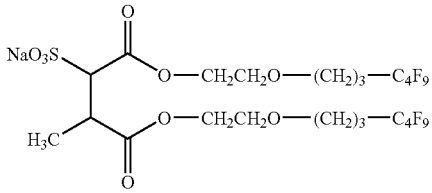

The compounds of formula (2) may be produced, for example, according to the methods described in German Patent 2,329,660, U.S. Pat. No. 4,968,599, and JP-A 1-19137. In these, the counter cation may be readily exchanged with ion-exchange resin or the like.

The compound of formula (3) (this may be referred to as "compound (3) of the invention" or "anionic non-fluorine compound of the invention") is described in detail.

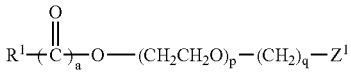

(3)

In this, $R^1$ represents an alkyl or alkenyl group having from 6 to 25 carbon atoms; q indicates from 2 to 4; p indicates from 0 to 30; p may be a single value or may be distributed, and when distributed, it indicates its mean value; a indicates 0 or 1; $Z^1$ represents $OSO_3M$ or $SO_3M$; M represents a cation.

In formula (3), $R^1$ represents an alkyl or alkenyl group having from 6 to 25 carbon atoms. Preferably, $R^1$ has from 6 to 22 carbon atoms, more preferably from 6 to 20 carbon atoms, even more preferably from 8 to 18 carbon atoms, still more preferably from 10 to 14 carbon atoms. The alkyl and alkenyl groups may have a cyclic structure, but are preferably linear alkyl and alkenyl groups. The alkyl and alkenyl groups may be substituted, but are preferably unsubstituted. The linear alkyl and alkenyl groups may be branched. The position of the double bond in the alkenyl group is not specifically defined. $R^1$ is preferably an alkyl group rather than an alkenyl group.

In formula (3), q indicates from 2 to 4, but is preferably 4. p indicates from 0 to 30; p may be a single value or may be distributed, and when distributed, it indicates its mean value. Preferably, p is from 0 to 20, more preferably from 0 to 10, even more preferably from 0 to 5, still more preferably from 1 to 4.

In formula (3), $Z^1$ represents $OSO_3M$ or $SO_3M$, and M represents a cation. Preferred examples of the cation for M are an alkali metal ion (e.g., lithium ion, sodium ion, potassium ion), an alkaline earth metal ion (e.g., barium ion, calcium ion), and an ammonium ion. Of those, more preferred are lithium ion, sodium ion, potassium ion and ammonium ion.

In formula (3), a indicates 0 or 1, but is preferably 0.

Of the compounds of formula (3), preferred are those of the following formula (3-A):

$$R^{1a}—O—(CH_2CH_2O)_{p1}—(CH_2)_{q1}—SOM_3 \quad (3\text{-}A)$$

wherein $R^{1a}$ represents an alkyl group having from 8 to 18 carbon atoms; q1 indicates from 2 to 4; p1 indicates from 0 to 5; p1 may be a single value or may be distributed, and when distributed, it indicates its mean value; M represents a cation, having the same meaning as in formula (3), and its preferred range is also the same as therein.

In formula (3), $R^{1a}$ represents an alkyl group having from 8 to 18 carbon atoms, preferably from 10 to 14 carbon atoms.

In formula (3), q1 indicates from 2 to 4, but is preferably 2 or 4, more preferably 4.

In formula (3), p1 indicates from 0 to 5; p1 may be a single value or may be distributed, and when distributed, it indicates its mean value. p1 is preferably from 1 to 4, more preferably from 1 to 3.

Examples of formula (3) are described in detail hereinunder, which, however, should not at all restrict the scope of the invention.

$C_6H_{13}—O—(CH_2CH_2O)_n—(CH_2)_2—SO_3Na$ (n=0–12) WS-1:

$C_6H_{13}—O—(CH_2CH_2O)_n—(CH_2)_3—SO_3Na$ (n=0–12) WS-2:

$C_6H_{13}—O—(CH_2CH_2O)_n—(CH_2)_4—SO_3Na$ (n=0–12) WS-3:

$C_8H_{17}—O—(CH_2CH_2O)_n—(CH_2)_2—SO_3Na$ (n=0–12) WS-4:

$C_8H_{17}—O—(CH_2CH_2O)_n—(CH_2)_3—SO_3Na$ (n=0–12) WS-5:

$C_8H_{17}—O—(CH_2CH_2O)_n—(CH_2)_4—SO_3Na$ (n=0–12) WS-6:

$C_{10}H_{21}—O—(CH_2CH_2O)_n—(CH_2)_2—SO_3Na$ (n=0–12) WS-7:

$C_{10}H_{21}—O—(CH_2CH_2O)_n—(CH_2)_3—SO_3Na$ (n=0–12) WS-8:

$C_{10}H_{21}—O—(CH_2CH_2O)_n—(CH_2)_4—SO_3Na$ (n=0–12) WS-9:

$C_{10}H_{21}—O—(CH_2CH_2O)_n—(CH_2)_4—SO_3K$ (n=0–12) WS-10:

$C_{10}H_{21}—O—(CH_2CH_2O)_n—(CH_2)_4—SO_3NH_3$ (n=0–12) WS- 11:

$C_{11}H_{23}—O—(CH_2CH_2O)_n—(CH_2)_2—SO_3Na$ (n=0–12) WS-12:

$C_{11}H_{23}—O—(CH_2CH_2O)_n—(CH_2)_3—SO_3Na$ (n=0–12) WS-13:

$C_{11}H_{23}—O—(CH_2CH_2O)_n—(CH_2)_4—SO_3Na$ (n=0–12) WS-14:

$C_{12}H_{25}—O—(CH_2CH_2O)_n—(CH_2)_2—SO_3Na$ (n=0–12) WS-15:

$C_{12}H_{25}—O—(CH_2CH_2O)_n—(CH_2)_3—SO_3Na$ (n=0–12) WS-16:

$C_{12}H_{25}—O—(CH_2CH_2O)_n—(CH_2)_4—SO_3Na$ (n=0–12) WS-17:

$C_{14}H_{29}—O—(CH_2CH_2O)_n—(CH_2)_2—SO_3Na$ (n=0–25) WS-18:

$C_{14}H_{29}—O—(CH_2CH_2O)_n—(CH_2)_3—SO_3Na$ (n=0–25) WS-19:

$C_{14}H_{29}—O—(CH_2CH_2O)_n—(CH_2)_4—SO_3Na$ (n=0–25) WS-20:

$C_{16}H_{33}—O—(CH_2CH_2O)_n—(CH_2)_3—SO_3NH_3$ (n=0–30) WS- 21:

$C_{16}H_{33}—O—(CH_2CH_2O)_n—(CH_2)_4—SO_3Na$ (n=0–30) WS-22:

$C_{18}H_{37}—O—(CH_2CH_2O)_n—(CH_2)_3—SO_3Na$ (n=0–30) WS-23:

$C_{18}H_{37}—O—(CH_2CH_2O)_n—(CH_2)_4—SO_3Na$ (n=0–30) WS-24:

$C_{20}H_{41}—O—(CH_2CH_2O)_n—(CH_2)_4—SO_3Na$ (n=0–30) WS-25:

$C_8H_{17}CH{=}CH(CH_2)_8—O—(CH_2CH_2O)_n—(CH_2)_3—SO_3Na$ (n=0–30) WS-26:

$C_{22}H_{45}—O—(CH_2CH_2O)_n—(CH_2)_2—SO_3Na$ (n=0–30) WS-27:

$C_{24}H_{49}—O—(CH_2CH_2O)_n—(CH_2)_2—SO_3Na$ (n=0–30) WS-28:

$C_{24}H_{49}—O—(CH_2CH_2O)_n—(CH_2)_2—SO_3Li$ (n=0–30) WS-29:

$C_6H_{13}—O—(CH_2CH_2O)_n—(CH_2)_2—OSO_3Na$ (n=0–12) WS-30:

$C_8H_{17}—O—(CH_2CH_2O)_n—(CH_2)_2—OSO_3Na$ (n=0–12) WS-31:

$C_9H_{19}—O—(CH_2CH_2O)_n—(CH_2)_2—OSO_3Na$ (n=0–12) WS-32:

$C_{10}H_{21}—O—(CH_2CH_2O)_n—(CH_2)_2—OSO_3Na$ (n=0–12) WS-33:

$C_{11}H_{23}—O—(CH_2CH_2O)_n—(CH_2)_2—OSO_3Na$ (n=0–12) WS-34:

$C_{12}H_{25}—O—(CH_2CH_2O)_n—(CH_2)_2—OSO_3Na$ (n=0–12) WS-35:

$C_{14}H_{29}—O—(CH_2CH_2O)_n—(CH_2)_2—OSO_3Na$ (n=0–20) WS-36:

$C_{16}H_{33}—O—(CH_2CH_2O)_n—(CH_2)_2—OSO_3Na$ (n=0–25) WS-37:

$C_{18}H_{37}—O—(CH_2CH_2O)_n—(CH_2)_2—OSO_3Na$ (n=0–30) WS-38:

$C_{18}H_{37}—O—(CH_2CH_2O)_n—(CH_2)_2—OSO_3K$ (n=0–30) WS-39:

$C_{18}H_{37}—O—(CH_2CH_2O)_n—(CH_2)_2—OSO_3Li$ (n=0–30) WS-40:

$C_7H_{15}C({=}O)O—(CH_2CH_2O)_2—(CH_2)_2—SO_3Na$ WS-41:

$C_9H_{19}C({=}O)O—(CH_2CH_2O)_4—(CH_2)_2—SO_3Na$ WS-42:

$C_9H_{19}C({=}O)O—(CH_2CH_2O)_6—(CH_2)_3—SO_3Na$ WS-43:

$C_9H_{19}C(=O)O—(CH_2CH_2O)_8—(CH_2)_4—SO_3Na$ WS-44:

$C_{11}H_{23}C(=O)O—(CH_2CH_2O)_{15}—(CH_2)_2—SO_3Na$ WS-45:

$C_8H_{17}CH=CH(CH_2)_7C(=O)O—(CH_2CH_2O)_{15}—(CH_2)_3—SO_3Na$ WS-46:

$C_{21}H_{43}C(=O)O—(CH_2CH_2O)_{20}—(CH_2)_2—SO_3Na$ WS-47:

The compounds of formula (3) may be produced according to known methods, for example, as in *J. Phys. Chem.,* 90, 2413 (1986); *J. Dispersion Sci. and Tech.,* 4, 361 (1983); and U.S. Pat. No. 5,602,087. In these, the counter cation may be suitably changed by selecting the base for neutralizing the sulfonic acid. In addition, the counter cation may be readily exchanged with ion-exchange resin or the like.

The substitute group T is described in detail. The substitute group T includes an alkyl group (preferably having from 1 to 20, more preferably from 1 to 12, even more preferably from 1 to 8 carbon atoms, such as methyl, ethyl, isopropyl, tert-butyl, n-octyl, n-decyl, n-hexadecyl, cyclopropyl, cyclopentyl, cyclohexyl), an alkenyl group (preferably having from 2 to 20, more preferably from 2 to 12, even more preferably from 2 to 8 carbon atoms, such as vinyl, alkyl, 2-butenyl, 3-pentenyl), an alkynyl group (preferably having from 2 to 20, more preferably from 2 to 12, even more preferably from 2 to 8 carbon atoms, such as propargyl, 3-pentynyl), an aryl group (preferably having from 6 to 30, more preferably from 6 to 20, even more preferably from 6 to 12 carbon atoms, such as phenyl, p-methylphenyl, naphthyl), a substituted or unsubstituted amino group (preferably having from 0 to 20, more preferably from 0 to 10, even more preferably from 0 to 6 carbon atoms, such as unsubstituted amino, methylamino, dimethylamino, diethylamino, dibenzylamino), an alkoxy group (preferably having from 1 to 20, more preferably from 1 to 12, even more preferably from 1 to 8 carbon atoms, such as methoxy, ethoxy, butoxy), an aryloxy group (preferably having from 6 to 20, more preferably from 6 to 16, even more preferably from 6 to 12 carbon atoms, such as phenyloxy, 2-naphthyloxy), an acyl group (preferably having from 1 to 20, more preferably from 1 to 16, even more preferably from 1 to 12 carbon atoms, such as acetyl, benzoyl, formyl, pivaloyl), an alkoxycarbonyl group (preferably having from 2 to 20, more preferably from 2 to 16, even more preferably from 2 to 12 carbon atoms, such as methoxycarbonyl, ethoxycarbonyl), an aryloxycarbonyl group (preferably having from 7 to 20, more preferably from 7 to 16, even more preferably from 7 to 10 carbon atoms, such as phenyloxycarbonyl), an acyloxy group (preferably having from 2 to 20, more preferably from 2 to 16, even more preferably from 2 to 10 carbon atoms, such as acetoxy, benzoyloxy), an acylamino group (preferably having from 2 to 20, more preferably from 2 to 16, even more preferably from 2 to 10 carbon atoms, such as acetylamino, benzoylamino), an alkoxycarbonylamino group (preferably having from 2 to 20, more preferably from 2 to 16, even more preferably from 2 to 12 carbon atoms, such as methoxycarbonylamino), an aryloxycarbonylamino group (preferably having from 7 to 20, more preferably from 7 to 16, even more preferably from 7 to 12 carbon atoms, such as phenyloxycarbonylamino), a sulfonylamino group (preferably having from 1 to 20, more preferably from 1 to 16, even more preferably from 1 to 12 carbon atoms, such as methanesulfonylamino, benzenesulfonylamino), a sulfamoyl group (preferably having from 0 to 20, more preferably from 0 to 16, even more preferably from 0 to 12 carbon atoms, such as sulfamoyl, methylsulfamoyl, dimethylsulfamoyl, phenylsulfamoyl), a carbamoyl group (preferably having from 1 to 20, more preferably from 1 to 16, even more preferably from 1 to 12 carbon atoms, such as unsubstituted carbamoyl, methylcarbamoyl, diethylcarbamoyl, phenylcarbamoyl), an alkylthio group (preferably having from 1 to 20, more preferably from 1 to 16, even more preferably from 1 to 12 carbon atoms, such as methylthio, ethylthio), an arylthio group (preferably having from 6 to 20, more preferably from 6 to 16, even more preferably from 6 to 12 carbon atoms, such as phenylthio), a sulfonyl group (preferably having from 1 to 20, more preferably from 1 to 16, even more preferably from 1 to 12 carbon atoms, such as mesyl, tosyl), a sulfinyl group (preferably having from 1 to 20, more preferably from 1 to 16, even more preferably from 1 to 12 carbon atoms, such as methanesulfinyl, benzenesulfinyl), an ureido group (preferably having from 1 to 20, more preferably from 1 to 16, even more preferably from 1 to 12 carbon atoms, such as unsubstituted ureido, methylureido, phenylureido), a phosphoramido group (preferably having from 1 to 20, more preferably from 1 to 16, even more preferably from 1 to 12 carbon atoms, such as diethylphosphoramido, phenylphosphoramido), a hydroxyl group, a mercapto group, a halogen atom (such as fluorine, chlorine, bromine, iodine), a cyano group, a sulfo group, a carboxyl group, a nitro group, a hydroxamic acid group, a sulfino group, a hydrazino group, an imino group, a heterocyclic group (preferably having from 1 to 30, more preferably from 1 to 12 carbon atoms, for example, a heterocyclic group having heteroatom(s) of nitrogen, oxygen and sulfur, such as imidazolyl, pyridyl, quinolyl, furyl, piperidyl, morpholino, benzoxazolyl, benzimidazolyl, benzothiazolyl), a silyl group (preferably having from 3 to 40, more preferably from 3 to 30, even more preferably from 3 to 24 carbon atoms, such as trimethylsilyl, triphenylsilyl). These substituents may be further substituted. When the group has two or more substituents, they may be the same or different. If possible, the substituents may bond to each other to form a ring.

The compounds (1) and (2) of the invention, and the optional compound (3) may be mixed with a medium that dissolves and/or disperses them, and may be added to the silver halide photographic material. The mixture may optionally contain any other component in accordance with the object of the invention. The medium is preferably an aqueous medium. The aqueous medium includes water, and a mixed solvent of water and an organic solvent except water (e.g., methanol, ethanol, isopropyl alcohol, n-butanol, methyl cellosolve, dimethylformamide, acetone). Preferably, water accounts for at least 50% by mass of the mixed solvent. The aqueous medium is preferably water alone, or a mixed solvent of water and alcohol (e.g., methanol, ethanol, isopropyl alcohol), more preferably water alone or a mixed solvent of water and methanol, even more preferably water alone.

The concentration of the compounds (1) and (2) in the solution or dispersion is preferably from 0.001% by mass to 40% by mass each, more preferably from 0.01% by mass to 20% by mass, even more preferably from 0.1% by mass to 10% by mass, still more preferably from 1% by mass to 10% by mass each. In the embodiments that contain the compound (3), the concentration of the compound (3) is preferably from 0.01 to 50% by mass, more preferably from 0.1 to 40% by mass, even more preferably from 1 to 30% by mass.

One type or two or more different types of the compounds (1) and (2) of the invention may be used herein, either each alone or as combined. If desired, any other surfactant may be combined with the compounds (1) and (2) for use herein.

The surfactant that may be combined with them may be any of anionic, cationic and non ionic surfactants. It may also be a polymer surfactant, and may be any other fluorine-containing surfactant or hydrocarbon-type surfactant than the specific surfactants of the invention. The surfactant that may be combined with the specific compounds is more preferably an anionic or non ionic surfactant. Examples of the surfactant that may be combined with them are described in JP-A 62-215272 (pp. 649–706); *Research Disclosures* (RD), Item 17643, pp. 26–27 (December 1978), Item 18716, p. 650 (November 1979), Item 307105, pp. 875–876 (November 1989).

The amount of the compounds (1) and (2) for use in the invention is not specifically defined, and may be determined in any desired manner depending on the structure and the use of the compounds, the type and the amount of the material in the aqueous composition, and the constitution of the medium.

For example, when the compounds (1) and (2) are used in the coating liquid for the uppermost hydrophilic colloid (gelatin) layer of the silver halide photographic material of the invention, the concentration of the compounds (1) and (2) to be in the coating composition is preferably from 0.003 to 0.5% by mass each, and is preferably from 0.001 to 5% by mass, more preferably from 0.003 to 1% by mass relative to the solid gelatin content of the composition.

[Silver Halide Photographic Material]

The silver halide photographic material of the invention is described in detail.

The silver halide photographic material of the invention contains at least one compound (1) and at least one compound (2), and may optionally contain any other various compounds. The compounds may be dissolved or dispersed in a medium. For example, for forming constitutive layers of the photographic material, there are mentioned various couplers, UV absorbents, color mixing preventing agents, anti static agents, scavengers, antifoggants, hardeners, dyes and preservatives. As so mentioned hereinabove, the aqueous coating compositions of the invention are preferably used in the upper most hydrophilic colloid layer of the photographic material. In this case, the coating composition may contain, in addition to hydrophilic colloid (e.g., gelatin) and the fluorine compounds of the invention, any other surfactant, mat agent, lubricant, colloidal silica, gelatin plasticizer, etc.

Preferably, the silver halide photographic material of the invention is sensitive to light, laser or X-ray radiation, and may be selected from monochromatic reversal film, monochromatic negative film, color reversal film, color negative film, film with photosensitive components digitally-scanned thereon, monochromatic reversal paper, monochromatic paper, color paper, reversal color paper, paper with photosensitive components laser-irradiated from digital data base, and photothermographic material. More preferably, the silver halide photographic material of the invention is sensitive to X-ray radiation.

The components of the silver halide photographic material of the invention are described in detail.

[Silver Halide Emulsion]

The silver halide emulsion for use in the invention is described.

1) Halogen Composition:

The photosensitive silver halide grains to be in the photographic material of the invention may be any of silver chloride, silver chlorobromide, silver bromide, silver iodobromide or silver iodochlorobromide grains. For rapid processability thereof as so mentioned hereinabove, the iodide content of the photosensitive silver halide grains is preferably from 0 mol % to 0.45 mol % on average, more preferably from 0.05 mol % to 0.40 mol %, even more preferably from 0.10 mol % to 0.30 mol %. The "average" value of the iodide content of the photosensitive silver halide grains is meant to indicate the mean value of the iodide content thereof that is obtained from the halogen composition of each photosensitive silver halide grain. The halogen composition distribution in the photosensitive silver halide grains may be uniform, or may stepwise or continuously vary. Core/shell-structured photosensitive silver halide grains may be used herein.

2) Grain Morphology:

For the photosensitive silver halide grains for use herein, halogen-conversion type grains such as those described in British Patent 635,841 and U.S. Pat. No. 3,622,318 may be preferred. One general method of halogen conversion of the grains comprises adding thereto an aqueous halide solution having a smaller solubility product with silver than that of the halide composition in the surface of the original (unconverted) grains. For example, an aqueous solution of potassium bromide and/or potassium iodide is added to tabular silver chloride or silver chlorobromide grains, and an aqueous solution of potassium iodide is to tabular silver bromide or silver iodobromide grains for halogen conversion of the grains. The concentration of the aqueous solution is preferably lower. More preferably, it is at most 30%, even more preferably at most 10%. Also preferably, the solution for halogen conversion is added to the system at a rate not higher than 1 mol %/min/mol of original (unconverted) silver halide. During halogen conversion, a part or all of sensitizing dye and/or silver halide-adsorbing substance may exist in the system. In place of the aqueous solution for halogen conversion, fine silver halide grains such as silver bromide, silver iodobromide or silver iodide may be added to the system. The size of the fine grains is generally at most 0.2 μm, but is preferably at most 0.1 μm, more preferably at most 0.05 μm. The halogen conversion in the invention is not limited to the method mentioned above. Any other methods may be suitably combined for it.

3) Grain Size:

Methods of forming photosensitive silver halide grains are well known in the art. For example, the methods described in JP-A 2-68539, U.S. Pat. No. 3,700,458, and *Research Disclosure*, Item 17029, June 1978 may be employed for forming the grains.

4) Method of Chemical Sensitization:

For chemical sensitization, employable are the methods described in JP-A 2-68539, page 10, from right upper column, line 13 to left lower column, line 16; and JP-A 5-313282 and 6-110144.

Concretely, various known methods of sulfur sensitization, selenium sensitization, reduction sensitization or gold sensitization in the presence of a silver halide-adsorbing substance may be employed for chemical sensitization of silver halide emulsions, and these methods may be effected either singly or as combined.

Gold sensitization is one typical method of noble metal sensitization, in which a gold complex salt is essentially used. The system may contain a complex salt of any other noble metal than gold, such as platinum, palladium or iridium. Examples of the complex salt are described in U.S. Pat. No. 2,448,060, and British Patent 618,061.

Sulfur compounds in gelatin may serve as a sulfur sensitizer. In addition, other various sulfur compounds such as thiosulfates, thioureas, thiazoles, rhodanines are also usable. Their examples are described in U.S. Pat. Nos. 1,574,944, 2,278,947, 2,410,689, 2,728,668, 5,501,313, 3,656,955. Selenium sensitizers are described in JP-A 6-110144.

Combining sulfur sensitization with a thiosulfate, and selenium sensitization and gold sensitization is useful. Stannous salts, amines, formamine disulfides and silane compounds are usable for a reduction sensitizer.

5) Antifoggant, Stabilizer:

Examples of antifoggant and stabilizer usable in the invention are described in JP-A 2-69539, from page 10, left lower column, line 17 to page 11, left upper column line 7, and from page 3, left lower column, line 2 to page 4, left lower column.

Concretely, azoles (e.g., benzothiazolium salts, nitroimidazoles, nitrobenzimidazoles, chlorobenzimidazoles, bromobenzimidazoles, nitroindazoles, benzotriazoles, aminotriazoles); mercapto compounds (e.g., mercaptothiazoles, mercaptobenzothiazoles, mercaptobenzimidazoles, mercaptothiadiazoles, mercaptotetrazoles, mercaptopyrimidines, mercaptotriazines); thioketo compounds such as oxazolinethione; azaindenes (e.g., triazaindenes, tetrazaindenes (especially 4-hydroxy-substituted (1,3,3a,7)tetrazaindenes), pentazaindenes); benzenethiosulfonic acid, benzenesulfinic acid, benzenesulfonic acid amide and the like that are known as antifoggant or stabilizer are usable herein.

In particular, nitron and its derivatives as in JP-A 60-76743 and 60-87322; mercapto compounds as in JP-A 60-80839; heterocyclic compounds and complex salts of heterocyclic compounds and acids (e.g., 1-phenyl-5-mercaptotetrazoles) as in JP-A 57-164735 are preferably used herein.

In addition, purines or nucleic acids, as well as polymer compounds as in JP-B 61-36213 and JP-A 59-90844 are also usable herein. In particular, azaindenes, purines and nucleic acid are preferably used. The amount of the compound to be added to the photographic material may be from 0.5 to 5.0 mmols, preferably from 0.5 to 3.0 mmols per mol of silver halide in the material.

6) Color Tone Improver:

Color tone improvers described in JP-A 62-276539, from page 2, left lower column, line 7 to page 10, left lower column, line 20; and JP-A 3-94249, from page 6, left lower column, line 15 to page 11, right upper column, line 19 are usable in the invention.

Concretely, the silver halide photographic emulsion layer is made to have a covering power of at least 60, and a dye having a maximum absorption wavelength between 520 and 560 nm and a dye having a maximum absorption wavelength between 570 and 700 nm are added to the silver halide photographic emulsion layer and/or any other layer in such a manner that the optical density increase owing to the transmission density of the dyes in the non-exposed area of the developed material could be at most 0.03.

For the silver halide photographic emulsion layer having a covering power of at least 60, typically usable are an emulsion of tabular grains and an emulsion of fine grains. In particular, a photographic emulsion of tabular silver halide grains having a thickness of at most 0.4 μm, and a mixed emulsion of a high-iodine surface-sensitized emulsion and an emulsion of grains that are inside-fogged with fine grains are effective for better color tone improvement.

A dye having a maximum absorption wavelength between 520 and 560 nm, preferably between 530 and 555 nm, and a dye having a maximum absorption wavelength between 570 and 700 nm, preferably between 580 and 650 nm are combined for the color tone improver for use herein. The maximum absorption wavelength as referred to herein is meant to indicate the maximum absorption wavelength of the dye that is in the photographic material.

The dye for use in the invention may be selected, for example, from anthraquinone dyes, azo dyes, azomethine dyes, indaniline dyes, oxonole dyes, carbocyanine dyes, styryl dyes, triphenylmethane dyes and others that have the predetermined absorption wavelength range. In view of the stability in development and the lightfastness thereof, and of the influences thereof on photographic properties such as desensitization, fogging and staining, preferred are anthraquinone dyes, azo dyes, azomethine dyes and indaniline dyes.

Preferred examples of the dyes are described in JP-A 62-276539, from page 3, left upper column, line 5 to page 9, left upper column, line 9.

These dyes may be dispersed in emulsion layers and other hydrophilic colloid layers (e.g., interlayer, protective layer, antihalation layer, filter layer) in various known methods. Concretely, it is described in JP-A 62-276539, from page 9, left upper column, line 14 to page 10, left lower column, line 20.

7) Color Sensitizing Dye:

Color sensitizing dyes described in JP-A 2-68539, from page 4, right lower column, line 4 to page 8, right lower column may be used in the invention.

Concretely, they are cyanine dyes, merocyanine dyes, complex cyanine dyes, complex merocyanine dyes, holopolar cyanine dyes, styryl dyes, hemicyanine dyes, oxonole dyes, hemioxonole dyes.

Sensitizing dyes that are useful in the invention are described, for example, in U.S. Pat. Nos. 3,522,052, 3,617,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,613,638, 3,615,635, 3,705,809, 3,632,349, 3,677,765, 3,770,449, 3,770,440, 3,769,025, 3,745,014, 3,713,826, 3,567,458, 3,625,698, 2,526,632, 2,503,776; JP-A 48-76525; and Belgian Patent 691,807. The amount of the sensitizing dye that may be added to the photographic material of the invention is preferably from 0.5 mmols to less than 4 mmols, more preferably from 0.5 mmols to less than 1.5 mmols per mol of silver halide.

II-1 to II-47 described in JP-A 2-68539, pp. 5–8 are examples of the sensitizing dyes.

8) Anti static Agent:

Surfactants as in JP-A 2-68539, from page 11, left upper column, line 14 to page 12, left upper column, line 9 may be used in the invention, serving as a coating aid, anti static agent or static charge controlling agent.

Examples of the surfactants that are used for such purposes are non ionic surfactants such as saponin (steroid type), alkyleneoxide derivatives (e.g., polyethylene glycol, polyethylene glycol/polypropylene glycol condensate, polyethylene glycol alkyl ethers or polyethylene glycol alkylaryl ethers, silicone/polyethylene oxide compounds), alkyl esters of saccharides; anionic surfactants such as alkylsulfonic acid salts, alkylbenzenesulfonic acid salts, alkylnaphthalenesulfonic acid salts, alkylsulfate esters, N-acyl-N-alkyltaurines, sulfosuccinate esters, sulfoalkylpolyoxyethylene alkylphenyl ethers; ampholytic surfactants such as alkylbetaines, alkylsulfobetaines; cationic surfactants such as aliphatic or aromatic quaternary ammonium salts, pyridinium salts, imidazolium salts.

Of those, especially preferred are saponin; anionic surfactants such as Na dodecylbenzenesulfonate, Na di-2-ethylhexyl-α-sulfosuccinate, Na p-octylphenoxyethoxyethanesulfonate, Na dodecylsulfate, Na triisopropylnaphthalenesulfonate, N-methyl-oleoyltaurine Na salt; cationic surfactants such as dodecyltrimethylammonium chloride, N-oleoyl-N',N',N'-trimethylammoniodiaminopropane bromide, dodecylpyridinium chloride; betaines such as N-dodecyl-N,N-dimethylcarboxybetaine, N-oleyl-N,N-dimethylsulfobutylbetaine; non ionic surfactants such as poly (mean polymerization degree, n=10)-oxyethylene cetyl ether, poly(n=25)-oxyethylene p-nonylphenyl ether, bis(1-poly(n=15)-oxyethylene-oxy-2,4-di-t-pentylphenyl)-ethane.

Non ionic surfactants, alkali metal nitrates, conductive tin oxide, zinc oxide, vanadium pentoxide, and antimony-doped composite oxides thereof, such as those described in JP-A 60-80848, 61-112144, 62-172343, 62-173459 are preferable anti static agents for use in the invention.

9) Mat Agent, Lubricant, Plasticizer:

Mat agents, lubricants and plasticizers described in JP-A 2-68539, page 12, from left upper column, line 10 to right upper column, line 10, and page 14, from left lower column, line 10 to right lower column, line 1 may be used in the invention.

Concretely, for mat agents, usable are fine particles of organic compounds such as polymethyl methacrylate homopolymer or methyl methacrylate/methacrylic acid copolymer, as well as those of inorganic compounds such as silica, titanium dioxide, sulfuric acid, strontium barium or the like, for example, as in U.S. Pat. Nos. 2,992,101, 2,701,245, 4,142,894, 4,396,706. Their particle size is preferably from 1.0 to 10 μm, more preferably from 2 to 5 μm.

The surface layer of the photographic material of the invention may contain a lubricant. The lubricant includes, for example, silicone compounds as in U.S. Pat. Nos. 3,489,576 and 4,047,958; colloidal silica as in JP-B 56-23139; as well as paraffin wax, higher fatty acid esters, starch derivatives.

The hydrophilic colloid layer in the silver halide photographic material of the invention may contain a polyol serving as a plasticizer. The polyol includes, for example, trimethylolpropane, pentanediol, butanediol, ethylene glycol, glycerin. The emulsion layer in the silver halide photographic material of the invention may contain a polymer or emulsion that serves as a plasticizer for improving the pressure resistance of the layer.

For example, British Patent (BP) 738, 618 discloses a method of using heterocyclic compounds; BP 738, 637 discloses a method of using alkyl phthalates; BP 738,639 discloses a method of using alkyl esters; U.S. Pat. No. 2,960,404 discloses a method of using polyalcohols; U.S. Pat. No. 3,121,060 discloses a method of using carboxyalkyl celluloses; JP-A 49-5017 discloses a method of using paraffin and carboxylic acid salts; and JP-B 53-28086 discloses a method of using alkyl acrylates and organic acids. These methods may apply to the present invention.

10) Hydrophilic Colloid:

Gelatin is advantageous for the binder or protective colloid to be in the emulsion layer, interlayer and surface-protective layer of the silver halide photographic material of the invention. Apart from it, any other hydrophilic colloid may also be used.

Examples of hydrophilic colloid usable in the invention are described in JP-A 2-68539, page 12, from right upper column, line 11 to left lower column, line 16.

For example, herein usable are proteins such as gelatin derivatives, graft polymers of gelatin and other polymers, albumin, casein; cellulose derivatives such as hydroxyethyl cellulose, carboxymethyl cellulose, cellulose sulfate esters; saccharide derivatives such as sodium alginate, dextran, starch derivatives; homopolymers, copolymers and other various synthetic hydrophilic polymer substances such as polyvinyl alcohol, polyvinyl alcohol partial acetal, poly(-N-vinylpyrrolidone, polyacrylic acid, polymethacrylic acid, polyacrylamide, polyvinyl imidazole, polyvinyl pyrazole.

Gelatin for use herein may be lime-processed gelatin, acid-processed gelatin, enzyme-processed gelatin, as well as hydrolyzed gelatin, or enzyme-decomposed gelatin.

Preferably, gelatin is combined with dextran or polyacrylamide having a mean molecular weight of at most 100,000 for use herein. The methods described in JP-A 63-68887 and 63-149641 are effective also in the invention.

11) Hardener:

The photographic emulsion and the non-photosensitive hydrophilic colloid for use in the invention may contain an inorganic or organic hardener. Examples of the hardener usable in the invention are described in JP-A 2-68539, from page 12, left lower column, line 17 to page 13, right upper column, line 6.

Concretely, they are chromium salts (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-methylenebis-(β-(vinylsulfonyl)propionamide)), active halogen compounds (e.g., 2,4-dichloro-6-hydroxy-s-triazine), mucohalogenic acids (e.g., mucochloric acid, mucophenoxychloric acid), isoxazoles, dialdehyde-starch, 2-chloro-6-hydroxytriazinylgelatin. One or more of these may be used herein either singly or as combined. In particular, the active vinyl compounds described in JP-A 53-41221, 53-57257, 59-162546, 60-80846; and the active halogen compounds described in U.S. Pat. No. 3,325,287 are preferred for use in the invention.

A polymer hardener is also effectively used in the invention. The polymer hardener usable herein includes, for example, dialdehyde-starch, polyacrolein; aldehyde group-having polymers such as acrolein copolymers as in U.S. Pat. No. 3,396,029; epoxy group-having polymers as in U.S. Pat. No. 3,623,878; dichlorotriazine group-having polymers as in U.S. Pat. No. 3,362,827, Research Disclosure, Item 17333 (1978); active ester group-having polymers as in JP-A 56-66841; polymers with an active vinyl group or its precursor group, as in JP-A 56-142524, U.S. Pat. No. 4,161,407, JP-A 54-65033, *Research Disclosure*, Item 16725 (1978). Polymers with an active vinyl group or its precursor group are preferred for use herein. In particular, those in which the active vinyl group or its precursor group bonds to the polymer backbone chain through a long spacer, as in JP-A-56-142524 are especially preferred.

Preferably, the hydrophilic colloid layer in the silver halide photographic material is hardened with the hardener as above in such a manner that the degree of swelling thereof in water could be at most 300%, more preferably at most 230%.

12) Support:

Examples of the support for use in the invention are described in JP-A 2-68539, page 13, right upper column, lines 7-20. Concretely, polyethylene terephthalate films or cellulose triacetate films are preferred for the support.

Preferably, the surface of the support is processed through corona discharging, glow discharging or UV irradiation for improving its adhesiveness to hydrophilic colloid layers. If desired, a subbing layer of styrene-butadiene-based latex or vinylidene chloride-based latex may be formed on the support, and a gelatin layer may be further formed on the subbing layer.

Also if desired, an organic solvent that contains a polyethylene-swelling agent and gelatin may be used for forming a subbing layer on the support. Thus formed, the subbing layer may be processed for surface treatment as above for further improving the adhesiveness of the support to hydrophilic colloid layers.

13) Crossover Cut Method:

Crossover light significantly lowers the sharpness of photographic material, and it is well known in the art. One method of reducing crossover light through photographic materials to at most 12% is disclosed in U.S. Pat. No. 4,130,429 and JP-A 61-116354, which comprises using sensitizers or dyes for absorbing the light that has the same wavelength as that of the emitting light of X-ray fluorescent screens.

On the other hand, U.S. Pat. No. 4,800,150 discloses a technique of forming a layer of fine crystal dispersion of dye between a support and an emulsion layer so as to reduce the crossover light through the structure to at most 10%. JP-A 63-305345 discloses a technique of fixing an anionic dye in a specific layer by the use of a cationic polymer latex; and JP-A 1-166031 discloses a technique of forming, as a subbing layer, a dye-fixed layer on a support. All of these methods may apply to the photographic material of the invention. In particular, the technique of forming, as a subbing layer, a dye-containing color layer on a support is preferred in the invention. Preferably, the dye is fixed in the color layer according to the method described in JP-A 1-166031. Especially preferably, the dye is fixed to the subbing layer in the form of a fine crystal dispersion thereof, as in U.S. Pat. No. 4,803,150. These methods may be suitably combined in the present invention.

Preferred examples of the dye for use in the invention are described in JP-A 2-264944, from page 4, left lower column to page 9, right upper column.

Regarding the mordant layer to be in the photographic material of the invention, referred to is the description given in JP-A 2-264944, from page 9, right lower column to page 14, right upper column.

14) Polyhydroxybenzenes:

Examples of polyhydroxybenzenes usable in the invention are described in JP-A 8-39948, from page 11, left upper column to page 12, left lower column; and EP 452772A.

Concretely mentioned are the compounds of formula (III) given on page 11, left upper column, and their examples of compounds (III)-1 to 25 given from page 11, left lower column to page 12, left lower column of JP-A 8-39948.

The amount of the polyhydroxybenzene compound that may be added to the photographic material may be smaller than $5\times10^{-1}$ mols per mol of silver halide, but is preferably from $1\times10^{-1}$ to $5\times10^{-3}$ mols per mol of silver halide.

The silver halide photographic material of the invention has, on a support thereof, a silver halide emulsion layer (photosensitive layer) that contains photosensitive silver halide grains, and at least one non-photosensitive hydrophilic colloid layer of interlayer, surface protective layer, back layer, back-protective layer, antihalation layer and filter layer. Emulsion sensitization and various additives applicable to the photographic material are not specifically defined, for which, for example, the description of JP-A 2-68539 may be referred to.

15) Surface-Protective Layer, Back-Protective Layer:

Preferably, the silver halide photographic material of the invention has a surface-protective layer and a back-protective layer, and the surface-protective layer and the back-protective layer contain various chemicals along with a hydrophilic colloid such as gelatin that serves as a binder. When the main ingredient of the layer is gelatin, the layer requires a preservative. Optionally but preferably, the protective layers contain mat agent, lubricant, plasticizer, anti static agent, surfactant, hardener, thickener, dye, electroconductive substance, etc.

16) Method of Development:

For developing the silver halide photographic material of the invention, employable are the methods described in JP-A 2-103037, from page 16, right upper column, line 7 to page 19, left lower column, line 15; JP-A 2-115837, from page 3, right lower column, line 5 to page 6, upper column, line 10; and JP-A 2000-112078, from page 34, left column, line 42 to page 35, left column, line 2. The methods described in JP-A 2001-255617, from page 31, right column, line 46 to page 32, right column, line 11 may apply to photothermographic materials.

The invention is described more concretely with reference to the following Examples. Not overstepping the scope and the sprit of the invention, the materials, the reagents, the proportions and the operations shown in the following Examples may be suitably changed or modified. Accordingly, the scope of the invention should not be limited by the description of the following Examples.

EXAMPLE 1

Silver halide photographic materials Nos. 1-1 to 1-7 were prepared in the same manner as in Example 3, except that the surfactant and its amount added to the surface-protective layer were varied as in Table 1 below.

Using Advantest's R12704, voltage was applied to the samples at a temperature of 25° C. and a relative humidity of 25% for 50 seconds, and the surface resistivity (log SR) of each sample was measured. A smaller Log SR means that the surface resistivity reduction in the sample is higher. To investigate the surface resistivity stability of each sample, the samples were stored for 1 week and for 2 months after they were prepared, and Log SR of each of the thus-aged samples was measured. The data are given in Table 1.

TABLE 1

| | Amount Added (/Gel. 100 g) | | | | | | | | |
|---|---|---|---|---|---|---|---|---|---|
| | (mg) | | | | (g) | | | | |
| | Nonionic Fluorine | | Anionic Fluorine | | Anionic Non-fluorine | | Log SR | | |
| Sample No | Compound | | Compound | | Compound | | 1 week | 2 months | Remarks |
| Sample 1-1 | T-2 | 413 | T-1 | 101 | T-5 | 2.3 | 12.5 | 12.6 | comparative sample |
| Sample 1-2 | — | — | FS-1 | 101 | T-5 | 2.3 | 12.7 | 13 | comparative sample |
| Sample 1-3 | — | — | FS-1 | 101 | WS-20 | 2.3 | 12.8 | 13.1 | comparative sample |
| Sample 1-4 | FS-104 | 413 | FS-7 | 101 | T-5 | 2.3 | 12.5 | 12.6 | sample of the invention |
| Sample 1-5 | FS-104 | 413 | FS-1 | 101 | WS-20 | 2.3 | 12.1 | 12.1 | sample of the invention |

TABLE 1-continued

| | Amount Added (/Gel. 100 g) | | | | | | | | |
|---|---|---|---|---|---|---|---|---|---|
| | (mg) | | | | (g) | | | | |
| | Nonionic Fluorine | | Anionic Fluorine | | Anionic Non-fluorine | | Log SR | | |
| Sample No | Compound | | Compound | | Compound | | 1 week | 2 months | Remarks |
| Sample 1-6 | FS-105 | 413 | FS-1 | 101 | WS-20 | 2.3 | 12.2 | 12.3 | sample of the invention |
| Sample 1-7 | FS-104 | 413 | FS-1 | 101 | T-5 | 2.3 | 12.5 | 12.5 | sample of the invention |

In Table 1, FS-104 and FS-105 are examples of the compound (1) of the invention, FS-1 and FS-7 are examples of the compound (2) of the invention, and WS-20 (n=3) is an example of the compound (3) of the invention, all mentioned hereinabove. The numeral in the column that indicates the amount of the compound added is the amount thereof in 100 g of gelatin. The structures of T-1, T-2 and T-5 are shown below.

T-1: $C_8F_{17}SO_2N(C_3H_7)(CH_2CH_2O)_4(CH_2)_4SO_3Na$

T-2: $C_8F_{17}SO_2N(C_3H_7)(CH_2CH_2O)_{16}H$

T-5: $C_8H_{17}—C_6H_4—O(CH_2CH_2O)_2CH_2CH_2SO_3Na$

From the data as above, it is obvious that the time-dependent change in Log SR of the samples of the invention that contain the compounds (1) and (2) is small, and this means that the compounds impart good static electrification stability to photographic materials. In addition, it is understood that the compound (3) of the invention is effective for further lowering Log SR.

EXAMPLE 2

1. Production of Samples 1-1. Preparation of Emulsion:

4 g of sodium chloride, 4 g of potassium iodide and 20 g of gelatin were added to one liter of water, and kept at 70° C. in a reactor. With stirring, 400 ml of an aqueous solution of silver nitrate (silver nitrate, 83 g) and 190 ml of an aqueous solution of 57 g of potassium bromide were added to the reactor in a mode of double-jet addition taking 16 minutes. Next, an aqueous solution of from 0.1 to 0.85 mols of ammonia was added to it, and then 250 ml of an aqueous solution of silver nitrate (silver nitrate, 123 g) and 275 ml of an aqueous solution of 82.5 g of potassium bromide were added thereto in a mode of double-jet addition taking 20 minutes. Then, this was physically ripened for 18 minutes at that temperature. Next, this was neutralized with an aqueous solution of acetic acid, then cooled to 35° C., and the soluble salts were moved through flocculation. Next, this was heated up to 40° C.; 23.7 ml of 50% (w/v) trimethylolpropane, 42 mg of Proxel, 32.5 g of gelatin, and, as a thickener, sodium polystyrenesulfonate (mean molecular weight, 600,000 were added to it; and its pH was controlled to be 6.6 with sodium hydroxide added to it. Thus prepared, the emulsion was heated up to 49° C.; 41 mg of 4-hydroxy-6-methyl-1,3,3a,7-tetrazaindene, 150 mg of the following sensitizing dye D-1, 0.93 mg of chloroauric acid, and 165 mg of potassium thiocyanate were added to it; after 15 minutes, 25 mg of 4,7-dithia-1,10-decanediol was added thereto; further after 10 minutes, 2.6 mg of sodium thiosulfate and 0.9 mg of selenium sensitizer A-1 were added thereto; then 1.76 g of 4-hydroxy-6-methyl-1,3,3a,7-tetrazaindene was added thereto; and this was rapidly cooled for solid formation. The process gave an emulsion. Regarding the crystal habit thereof, the emulsion grains were corner-rounded 14-hedral grains. Analyzed with a master sizer, the grains had a grain size of from 0.45 to 1.14 μm in terms of the sphere-corresponding diameter thereof.

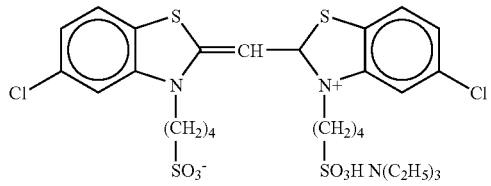

Sensitizing dye

A-1

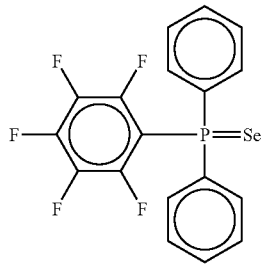

1-2. Preparation of Emulsion Coating Liquid, and Coating:

The following chemicals were added to the emulsion to prepare an emulsion coating liquid. The amount of each chemical mentioned below is per kg of the emulsion (silver, 1.52 mols).

| | |
|---|---|
| Gelatin | 38.2 g |
| Sodium polystyrenesulfonate (weight-average molecular weight, 600,000) | 1.4 g |
| Polyacrylamide (weight-average molecular weight, 45,000) | 27.2 g |
| Compound A-2 | 24.3 mg |
| Compound A-3 | 92.0 mg |
| Compound A-4 | 105.0 mg |
| Compound A-5 | 73.5 mg |
| Palladium chloride | 19.9 μmols |
| 1,3-Dihydroxybenzene | 1.2 g |
| 1,2-Bis(vinylsulfonylacetamido)ethane | 1.2 g |
| Dai-Nippon Ink's DV-759L (20% (w/v) aqueous solution) (composite latex of acrylate polymer with $SiO_2$) | 45.0 ml |
| Water to make | 2400 ml |

The coating liquid was applied onto both surfaces of a 0.18 mm-thick polyester base in such a manner that the amount of the coating liquid, as silver on one surface, could be 2.2 g/m$^2$.

A-2

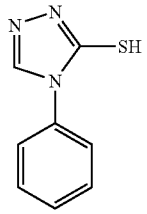

A-3

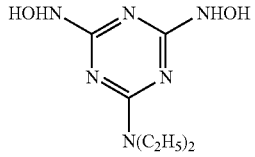

A-4

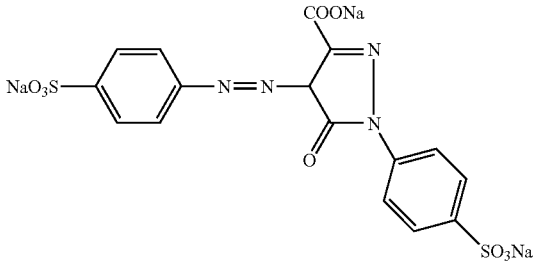

A-5

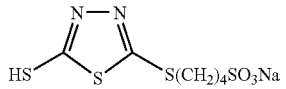

1-3. Preparation of Surface-Protective Layer Coating Liquid, and Coating:

Surface-protective layer coating liquids with different surfactant as in Table 2 were prepared. The coating liquid was applied onto both emulsion layers formed previously. Various coated samples were thus prepared. The coating amount was so controlled that the amounts of the constitutive components could be as follows:

| | |
|---|---|
| Gelatin | 0.78 g/m$^2$ |
| Polymethyl methacrylate (mat agent, mean particle size 3.7 μm) | 46.7 mg/m$^2$ |
| Proxel | 0.37 mg/m$^2$ |
| Sodium polyacrylate (weight-average molecular weight, 400,000) | 0.98 mg/m$^2$ |

Surfactant of the Invention, or Comparative Surfactant (as in Table 2)

| | |
|---|---|
| Compound A-6 | 40.5 mg/m$^2$ |
| $C_9H_{19}$—Ph—$O(CH_2CH_2O)_{50}H$ | 2.16 mg/m$^2$ |
| Nissan Chemical's Snowtex C (colloidal silica having a grain size of around 10 nm) (pH controlled to 6.9 with sodium hydroxide) | 0.18 g/m$^2$ |

-continued

A-6

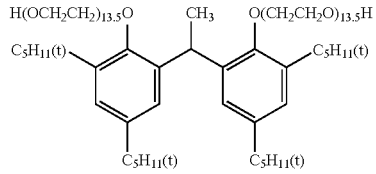

Thus produced, the samples Nos. 2-1 to 2-4 were evaluated in the same manner as in Example 1. In addition, they were evaluated in point of the anti static property thereof, according to the method mentioned below. The data are given in Table 2 and Table 3 along with the data of the samples produced in Examples 3 to 7.

The samples of the invention have good coated surface condition (with few spotting defects) and do not stain processing solutions, and are therefore good for practical use.

EXAMPLE 3

1. Formation of Subbing Layer-Coated Support

1) Preparation of Dye D-1 for Subbing Layer:

The dye mentioned below was ball-milled according to the method described in JP-A 63-197943. A dye dispersion D-1 was thus prepared.

Dye for Dye Dispersion D-1:

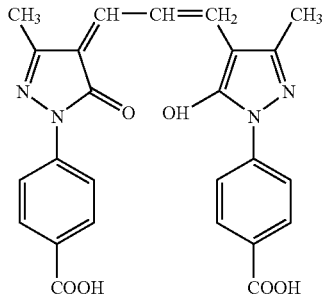

434 ml of water and 791 ml of 6.7 mas % solution of Triton X-200 (surfactant, TX-200) were put into a 2-liter ball mill. 20 g of the dye was added to the solution. 400 ml of zirconium oxide (ZrO) beads (2 mm diameter) were added to it, and the contents were ground with them for 4 days. Next, 160 g of 12.5 mas % gelatin was added to it. This was defoamed, and then ZrO beads were removed through filtration. The resulting dye dispersion was observed. The ground dye particles had a broad diameter distribution of from 0.05 to 1.15 μm, and their mean particle size was 0.37 μm. The dye dispersion was centrifuged to remove large dye particles having a diameter of 0.9 μm or more. The dye dispersion D-1 was thus prepared.

2) Preparation of Support:

A 183 μm-thick, biaxial-oriented polyethylene terephthalate film was subjected to corona-discharge treatment, and a first subbing liquid having the composition mentioned below was applied thereto with a wire bar coater in such a manner that the coating amount could be 5.1 ml/m$^2$, and then dried at 175° C. for 1 minute. Next, the opposite side of the film was processed in the same manner also to form the same first subbing layer thereon. The polyethylene terephthalate used herein contained 0.04% by mass of Dye-1 having the structure mentioned below.

Dye-1:

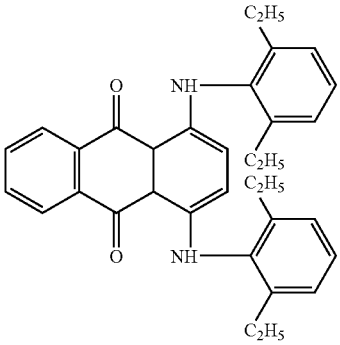

— Composition of First Subbing Layer —

The amount of the coating liquid was 4.9 ml per $m^2$ of one side of the support, and the coating amount of each constitutive component was as follows, per $m^2$ of one side of the support:

Styrene-butadiene copolymer latex (as solid) 0.31 g (*The latex contained a surfactant having the structure D-2 mentioned below, as an emulsified dispersion thereof in an amount of 0.4% by mass relative to the solid content of the latex.)

2,4-Dichloro-6-hydroxy-s-triazine sodium salt 8 mg

D-2:

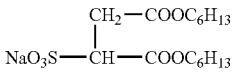

In addition, a second subbing liquid was applied onto the first subbing layers, one by one by the use of a wire bar coater at 150° C., and dried to form a second subbing layer thereon. The coating amount of the second subbing liquid is shown below.

— Composition of Second Subbing Layer —

The amount of the coating liquid was 7.9 ml per $m^2$ of one side of the support, and the coating amount of each constitutive component was as follows, per $m^2$ of one side of the support:

| | |
|---|---|
| Gelatin | 81 mg |
| $C_{12}H_{25}O(CH_2CH_2O)_{10}H$ | 3.8 mg |
| B-1 | 0.28 mg |
| Mat agent of polymethyl metharcylate having a mean particle size of 2.5 μm | 2.3 mg |
| Polymer latex of ethyl acrylate/acrylic acid = 95/5 (*This contained B-1 in an amount of 3% by weight relative to the polymer solid content of the latex) | 21 mg |

-continued

| | |
|---|---|
| Dye dispersion D-1 | 8.2 mg |
| Acetic acid | 0.6 mg |

B-1:

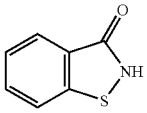

2. Preparation of Coating Liquids

1) Preparation of Silver Halide Emulsion T-1:

6 g of potassium bromide and 7 g of gelatin were added to one liter of water, and kept at 55° C. in a reactor. With stirring, 37 ml of an aqueous solution of silver nitrate (silver nitrate, 4.00 g) and 38 ml of an aqueous solution of 5.9 g of potassium bromide were added to the reactor in a mode of double-jet addition taking 37 seconds. Next, 18.6 g of gelatin was added to it, and then this was heated up to 70° C. 89 ml of an aqueous solution of silver nitrate (silver nitrate, 9.8 g) was added to it, taking 22 minutes. 7 ml of aqueous 25% ammonia solution was added to it, and this was physically ripened for 10 minutes at that temperature. Then, 6.5 ml of 100% acetic acid was added to it. Next, an aqueous solution of 153 g of silver nitrate and an aqueous solution of potassium bromide were added to it in a mode of controlled double-jet addition taking 35 minutes with its pAg kept at 8.5. Next, an aqueous solution of silver nitrate was added to it to thereby control the system pBr to 2.8, and then 15 ml potassium thiocyanate solution (2 mol/liter) was added to it. This was physically ripened for 5 minutes at that temperature, and then cooled to 35° C. The grains thus formed were monodispersed tabular grains of pure silver bromide having a mean projected area diameter of 1.10 μm, a thickness of 0.165 μm and a diameter fluctuation coefficient of 18.5%. Soluble salts were removed from the resulting emulsion through flocculation. This was again heated up to 40° C., and 30 g of gelatin, 2.35 g of phenoxyethanol and, as a thickener, 0.8 g of sodium polystyrenesulfonate were added to it. Then, this was controlled to have a pH of 5.90 and a pAg of 8.25 with sodium hydroxide and silver nitrate solution added thereto. With stirring at 56° C., the emulsion was chemically sensitized. Before and during the chemical sensitization, AgI fine particles were added to it, each in an amount of 0.05 mol % relative to one mol of the monodispersed tabular grains of pure silver bromide in the emulsion. Concretely, 0.043 g of thiourea dioxide was added to it, and the emulsion was kept as such for 22 minutes to undergo reduction sensitization. Next, 20 mg of 4-hydroxy-6-methyl-1,3,3a,7-tetrazaindene and 400 mg of sensitizing dye A were added to it. Further, 0.83 g of calcium chloride was added to it. Next, as sensitizers, 1.5 mg of sodium thiosulfate, 2.2 mg of A-1, 2.6 mg of chloroauric acid and 90 mg of potassium thiocyanate were added to it, and after 40 minutes, the emulsion was cooled to 35° C. In that manner, an emulsion T-1 of tabular silver halide grains was prepared. The mean iodide content of the silver halide grains in the silver halide emulsion T-1 was 0.1 mol %.

2) Preparation of Silver Halide Emulsion T-2:

A silver halide emulsion T-2 was prepared in the same manner as that for the silver halide emulsion T-1, except that the amount of AgI fine particles to be added before and during chemical sensitization was varied to 0.5 mol % each.

The mean iodide content of the silver halide grains in the silver halide emulsion T-2 was 1.0 mol %.

Sensitizing Dye A:

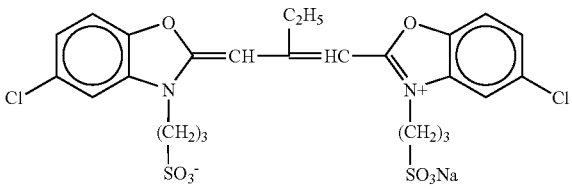

3) Formation of Coated Samples:

Additive components were added to the emulsion T-1 to prepare a coating liquid of emulsion T-1 in such a controlled manner that the coating amount of the constitutive components could be as follows:

| | |
|---|---|
| Coating silver amount | 1.09 g/m$^2$ |
| Dextran (mean molecular weight, 39,000) | 0.21 g/m$^2$ |
| Sodium polystyrenesulfonate (mean molecular weight, 600,000) | 19 mg/m$^2$ |
| Hardener, 1,2-bis(vinylsulfonylacetamido) ethane | 26 mg/m$^2$ |
| B-2 | 4.1 mg/m$^2$ |
| A-2 | 0.2 mg/m$^2$ |
| A-3 | 1.1 mg/m$^2$ |
| A-5 | 0.1 mg/m$^2$ |
| $C_{16}H_{33}$ $(CH_2CH_2O)_{10}H$ | 0.02 g/m$^2$ |

Additive components were added to the emulsion T-2 to prepare a coating liquid of emulsion T-2 in such a controlled manner that the coating amount of the constitutive components could be as follows:

| | |
|---|---|
| Coating silver amount | 0.66 g/m$^2$ |
| Dextran (mean molecular weight, 39,000) | 0.13 g/m$^2$ |
| Sodium polystyrenesulfonate (mean molecular weight, 600,000) | 11 mg/m$^2$ |
| Hardener, 1,2-bis(vinylsulfonylacetamido)ethane | 27 mg/m$^2$ |
| B-2 | 1.2 mg/m$^2$ |
| A-2 | 0.1 mg/m$^2$ |
| A-3 | 0.6 mg/m$^2$ |
| A-5 | 0.5 mg/m$^2$ |
| B-3 | 0.06 g/m$^2$ |
| B-4 | 0.34 g/m$^2$ |

B-2:

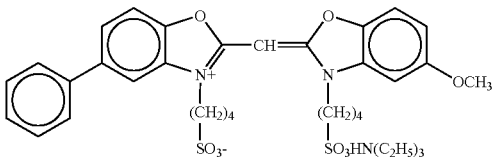

B-3:

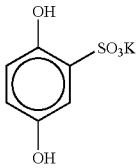

B-4:

-continued

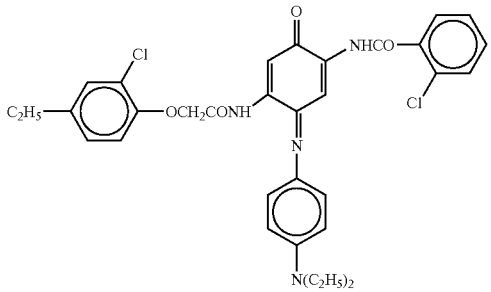

— Preparation of Surface-Protective Layer Coating Liquid —

Surface-protective layer coating liquids with different surfactant as in Table 2 were prepared. These were applied to the samples to form a surface-protective layer thereon.

| Constituent Components | Coating Amount |
|---|---|
| Gelatin | 0.966 g/m$^2$ |
| Sodium polyacrylate (mean molecular weight, 400,000) | 0.023 g/m$^2$ |
| 4-Hydroxymethyl-1,3,3a,7-tetrazaindene | 0.015 g/m$^2$ |
| Polymethyl methacrylate (mean particle size, 3.7 μm) | 0.087 g/m$^2$ |
| Proxel (pH controlled to 7.4 with NaOH) | 0.0005 g/m$^2$ |
| Surfactant of the invention, or comparative surfactant | (as in Table 2) |
| $C_{16}H_{33}O(CH_2CH_2O)_{10}H$ | 0.045 g/m$^2$ |
| $C_{17}H_{35}CON(CH_3)CH_2SO_3Na$ | 0.0065 g/m$^2$ |
| B-5 | 0.0017 g/m$^2$ |

B-5:

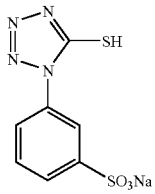

3. Coating

The emulsions T-1 and T-2, and the emulsion-protective layer coating liquid were applied onto both surfaces of the subbed support that had been prepared in the above, in a mode of coextrusion to form an emulsion layer and a surface protective layer thereon. The coating silver amount per one side was 1.75 g/m$^2$.

4. Evaluation of Samples

Thus produced, the samples 3-1 to 3-4 were evaluated in the same manner as in Example 1. The data are given in Table 2. In addition, they were evaluated in point of the anti static property thereof, according to the method mentioned below. The data are given in Table 3.

EXAMPLE 4

1. Preparation of Silver Halide Emulsion 21 g of gelatin, 10.7 g of $NH_4NO_3$, 0.3 g of KBr and 0.07 g of $AgNO_3$ were added to one linter of water, and kept at 42° C. in a reactor. With stirring, an aqueous solution of 85.7 g of $AgNO_3$ and 0.71 g of $NH_4NO_3$, and an aqueous solution of KBr were added to it in a mode of controlled double-jet addition taking 19 minutes and 10 seconds. After the start of double-jet addition, 2.4 ml of aqueous 25 wt. % ammonia was added to it; and this was neutralized with 0.71 g of glacial acetic acid. Next, an aqueous solution of 85.7 g of $AgNO_3$ and 0.71 g of $NH_4NO_3$, and an aqueous solution of 39.6 g of KBr, 1.17 g of KI and 0.52 mg of $K_3IrCl_6$ were added to it in a mode of double-jet addition taking 8 minutes and 40 seconds. The period "t" was so controlled that the sphere-corresponding diameter of the silver halide grains formed in this stage could be 0.21 μm. Next, this was cooled to 35° C., and the soluble salts were removed through flocculation. Then, this was heated up to 60° C.; 156 g of gelatin and 5 g of 2-phenoxyethanol were added to it; and this was controlled to have pH of 6.70 with NaOH and sulfuric acid added thereto. Next, 56 mg of 1-phenyl-5-mercaptotetrazole, 4.79 mg of sodium thiosulfate, 124 mg of 4,7-dithia-1,10-decanediol, 49.57 mg of HAuCl and 43.4 mg of potassium thiocyanate were added to it; after T minutes, 0.91 g of 4-hydroxy-6-methyl-1,3,3a,7-tetrazaindene as added to it; and then this was rapidly cooled for solid formation to prepare a raw emulsion. Regarding the crystal habit thereof, the emulsion grains were cubic, and the sphere-corresponding grain size thereof was 0.21 μm.

2. Preparation of Emulsion Coating Liquid 0.2 g of 2,4-dihydroxybenzaldehydoxime, 0.66 g of KBr, 3.26 g of sodium p-toluenesulfonate, 0.10 g of sodium 3-(5-mercapto-1-tetrazolyl)benzenesulfonate, 28 mg of lipoic acid, 0.8 g of 1,3-dihydroxybenzene, 82 mg of 3,4-dimethylthiazoline-2-thione, 9.1 mg of B-4, 6.4 mg of Compound J, and 0.60 g of 2,4-dichloro-6-hydroxy-1,3,5-triazine sodium salt were added to one kg of the raw emulsion, and water was added thereto to make 1043 ml in total.

Compound J:

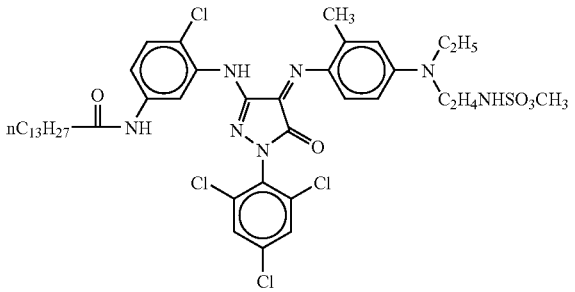

3. Preparation of Protective Layer Coating Liquid 9865 ml of water, 921 ml of methanol, 28.8 g of PMMA mat agent having a particle size of 5.5 μm, 4.5 g of Compound A-6, and a surfactant of the invention or a comparative surfactant (as in Table 2) were added to one kg of beef bone-derived, lime-processed gelatin (pH 6.0; jelly strength 260 g; Ca content 2700 ppm). This was controlled to have pH of 5.1 with phosphoric acid added thereto. Next, 209 g, as solid, of Boncoat DV-759 (by Dai-Nippon Ink), and 3.56 g of 2,4-dichloro-6-hydroxy-1,3,5-triazine sodium salt were added to it.

4. Formation of Coated Samples

The emulsion layer coating liquid and the protective layer coating liquid were applied onto both surfaces of the same support as in Example 2. The coating silver amount per one side was 7.35 g/m$^2$; the coating gelatin amount was 12.0 g/m$^2$ in the emulsion layer and was 2.21 g/m$^2$ in the protective layer. Samples Nos. 4-1 to 4-3 were thus formed.

A sample No. 4-4 was formed in the same manner as above, except that the emulsion layer coating liquid and the protective layer coating liquid were applied onto one surface of the support and coating liquids mentioned below were applied onto the other surface not coated with the emulsion layer.

5. Formation of Back Layer and Back-Protective Layer (BPC)

To the back of the sample having the emulsion layer and the emulsion-protective layer on one surface thereof, the following back layer coating liquid and back-protective layer (BPC) coating liquid were applied.

1) Preparation of Back Layer Coating Liquid:

One g of Proxel (by ICI), 3.5 g of 2,4-dichloro-6-hydroxy-1,3,5-triazine sodium salt, from 0 to 1514 ml of Nissan Chemical's Snowtex C (20% solution, particle size 10 nm), and from 0 to 1500 ml of polymer latex [poly(ethyl acrylate/methacrylic acid)=97/3] were added to one kg of gelatin of the same type as that used in the protective layer; and water was added to it to make 9730 ml in total.

2) Preparation of BPC Layer Coating Liquid:

The BPC layer coating liquid has the same composition as that of the emulsion-protective layer coating liquid, except that 0.6 g/m$^2$, as solid, of Snowtex C was added thereto as a mat agent, in place of the mat agent PMMA having a particle size of 8 μm.

3) Formation of Back Layer, BPC Layer:

The back layer coating liquid and the BPC layer coating liquid were applied at the same time to the samples in a mode of simultaneous coating, and dried. The coating gelatin amount in the back layer was 11 g/m$^2$, and was 1.7 g/m$^2$ in the BPC layer.

6. Evaluation of Samples

Thus produced, the samples 4-1 to 4-4 were evaluated in the same manner as in Example 1. The data are given in Table 2. In addition, they were evaluated in point of the anti static property thereof, according to the method mentioned below. The data are given in Table 3.

EXAMPLE 5

1. Preparation of Emulsions

1) Preparation of Silver Iodobromide Emulsion (O):

39 g of gelatin was dissolved in one liter of $H_2O$, and kept at 65° C. in a reactor. 6.4 mg of sodium thiosulfate, 1.3 g of acetic acid, 1.4 g of ammonium hydroxide, 15 mg of silver nitrate, 61 mg of potassium bromide, and 3.8 g of E-1 mentioned below were added to it; and then 560 ml of an aqueous solution of 192 g of silver nitrate and 0.77 g of ammonium nitrate, and 470 ml of an aqueous solution containing potassium hexachloroiridate (III) in such an amount that the molar ratio of iridium to the finished silver halide could be $2.3\times10^{-7}$, and containing 130 g of potassium bromide were added to it in a mode of double-jet addition. Next, 0.11 g of potassium iodide was added to it to give monodispersed cubic grains of silver iodobromide having a mean grain size of 0.51 μm. E-2 mentioned below was added to the emulsion; then this was desalted; 48 g of gelatin, 0.45 g of sodium polystyrenesulfonate and 2.8 g of phenoxyethanol were added to it; this was controlled to have pH of 6.2; 1.4 mg of sodium thiosulfate and 3.9 mg of chloroauric acid were added to it to attain chemical sensitization at 62° C.; and then 0.38 g of 4-hydroxy-6-methyl-1,3,3a,7-tetrazaindene was added to it, and this was rapidly cooled for solid formation.

E-1:

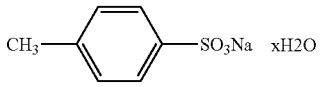

E-2:

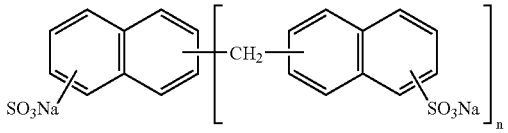

2) Preparation of Silver Iodobromide Emulsion (P):

38 g of gelatin was dissolved in one liter of $H_2O$, and kept at 55° C. in a reactor. 6.4 mg of sodium thiosulfate, 1.3 g of acetic acid, 0.80 g of ammonium hydroxide, 6.1 mg of silver nitrate, 61 mg of potassium bromide, and 3.8 g of E-1 were added to it; and then 590 ml of an aqueous solution of 190 g of silver nitrate and 0.77 g of ammonium nitrate, and 450 ml of an aqueous solution containing potassium hexachloroiridate (III) in such an amount that the molar ratio of iridium to the finished silver halide could be $9.0\times10^{-7}$, and containing 130 g of potassium bromide were added to it in a mode of double-jet addition. Next, 0.14 g of potassium iodide was added to it to give monodispersed cubic grains of silver iodobromide having a mean grain size of 0.36 μm. E-3 mentioned below was added to the emulsion; then this was desalted; 48 g of gelatin, 0.14 g of nucleic acid/base mixture, 0.16 g of potassium bromide, and 2.2 g of phenoxyethanol were added to it; this was controlled to have pH of 6.0; 4.1 mg of sodium thiosulfate and 7.4 mg of chloroauric acid were added to it to attain chemical sensitization at 60° C.; and then 0.37 g of 4-hydroxy-6-methyl-1,3,3a,7-tetrazaindene was added to it, and this was rapidly cooled for solid formation.

E-3:

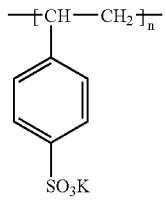

2. Preparation of Emulsion Coating Liquid

The emulsions O and P were mixed in a ratio of 1/2.1 in terms of mol of silver halide, and the following additives were added to the mixed emulsion to prepare a coating liquid. The amount of each chemical mentioned below is per mol of silver halide in the emulsion.

| | |
|---|---|
| Color sensitizing dye E-4 (mentioned below) | $3.6\times10^{-5}$ mols |
| Super-sensitizer E-5 (mentioned below) | $1.5\times10^{-4}$ mols |
| 3-Allyl-2,6-dimethylbenzothiazolium bromide | $5.7\times10^{-4}$ mols |
| E-6 (mentioned below) | $2.5\times10^{-4}$ mols |
| Polyacrylamide (molecular weight, 40,000 to 50,000) | 9.3 g |
| Sodium polystyrenesulfonate | 0.85 g |
| Poly(ethyl acrylate/methacrylic acid) latex | 26 g |
| 1,2-Bis(vinylsulfonylacetamido)ethane | 1.8 g |
| 1,3-Bis(vinylsulfonylacetamido)propane | 0.59 g |

E-4

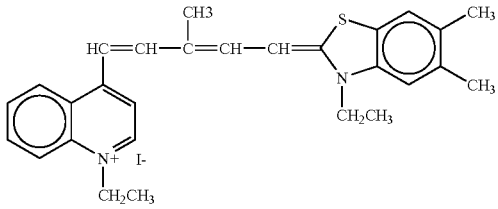

E-5:

-continued

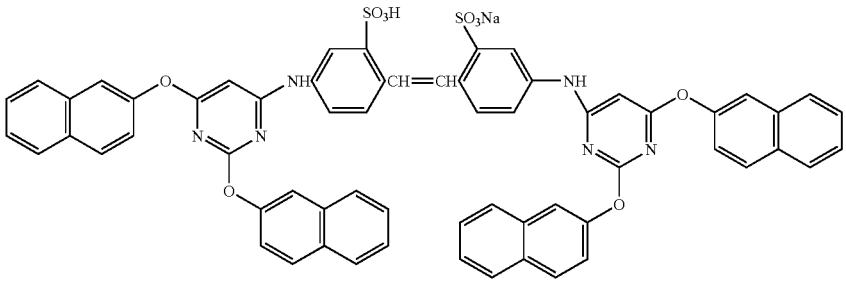

E-6:

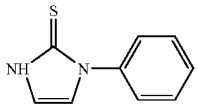

3. Preparation of Emulsion-Protective Layer Coating Liquid

A reactor was kept heated at 65° C., and the following chemicals were put into it to prepare an emulsion-protective layer coating liquid.

1) Formulation of Emulsion-Protective Layer Coating Liquid:

| | |
|---|---|
| Gelatin | 100 g |
| Polyacrylamide (molecular weight, 40,000 to 50,000) | 12 g |
| Sodium polystyrenesulfonate | 0.15 g |
| 1,2-Bis(vinylsulfonylacetamido)ethane | 1.4 g |
| 1,3-Bis(vinylsulfonylacetamido)propane | 0.46 g |
| Fine particles of polymethyl methacrylate (mean particle size, 2.8 μm) | 2.6 g |
| Fine particles of polymethyl methacrylate (mean particle size, 0.7 μm) | 3.0 g |
| $C_{16}H_{33}O—(CH_2CH_2O)_{10}—H$ | 3.3 g |
| Sodium polyacrylate (molecular weight, about 100,000) | 3.7 g |

Surfactant of the Invention, or Comparative Surfactant (as in Table 2)

| | |
|---|---|
| NaOH (1 N) | 3 ml |
| Methanol | 78 ml |
| B-1 | 52 mg |

4. Preparation of Back Layer Coating Liquid

A reactor was kept heated at 65° C., and the following chemicals were put into it to prepare a back layer coating liquid.

(Formulation of Back Layer Coating Liquid)

| | |
|---|---|
| Gelatin | 100 g |
| Antihalation dye E-7 (see below) | 2.3 g |
| Sodium polystyrenesulfonate | 1.7 g |

-continued

| | |
|---|---|
| Poly(ethyl acrylate/methacrylic acid) latex | 3.3 g |
| 1,2-Bis(vinylsulfonylacetamido)ethane | 2.5 g |
| 1,3-Bis(vinylsulfonylacetamido)propane | 0.84 g |
| B-1 | 45 mg |
| B-4 | 6.0 g |
| Nissan Chemical's Snowtex C (particle size, 10 nm) | 20 g |
| Phosphoric acid | 0.40 g |
| A-6 | 0.78 g |

E-7:

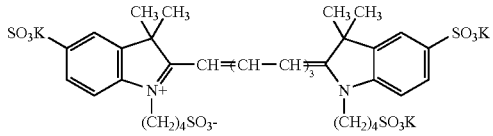

A reactor for back-protective layer coating liquid was kept heated at 65° C., and the following chemicals were put into it to prepare a back-protective layer coating liquid.

(Formulation of Back-Protective Layer Coating Liquid)

| | |
|---|---|
| Gelatin | 100 g |
| Sodium polystyrenesulfonate | 0.3 g |
| 1,2-Bis(vinylsulfonylacetamido)ethane | 1.3 g |
| 1,3-Bis(vinylsulfonylacetamido)propane | 0.43 g |
| Fine particles of polymethyl methacrylate (mean particle size, 5.8 μm) | 3.3 g |
| $C_{16}H_{33}O—(CH_2CH_{20}O)_{10}—H$ | 2.9 g |
| Sodium polyacrylate (molecular weight, about 100,000) | 1.3 g |

Surfactant of the Invention, or Comparative Surfactant (as in Table 2)

| | |
|---|---|
| NaOH (1 N) | 7 ml |
| Methanol | 110 ml |
| B-1 | 45 mg |

5. Formation of Photographic Materials

The back layer coating liquid and the back-protective layer coating liquid were together applied onto one side of a polyethylene terephthalate support. The gelatin coating amount in the back layer was 2.4 g/m$^2$; the gelatin coating amount in the back-protective layer was 1.4 g/m$^2$; and the total gelatin coating amount in the two layers was 3.8 g/m$^2$.

Next, the emulsion coating liquid and the emulsion-protective layer coating liquid were together applied onto the other side of the support. The silver coating amount in the emulsion layer was 2.8 g/m$^2$; and the gelatin coating amount in the emulsion-protective layer was 1.2 g/m$^2$.

6. Evaluation of Samples

Thus produced, the samples 5-1 and 5-2 were evaluated in the same manner as in Example 1. The data are given in Table 2. In addition, they were evaluated in point of the anti static property thereof, according to the method mentioned below. The data are given in Table 3.

EXAMPLE 6

1. Preparation of Emulsions

1) Preparation of Silver Iodobromide Emulsion (O):

39 g of gelatin was dissolved in one liter of $H_2O$, and kept at 65° C. in a reactor. 6.4 mg of sodium thiosulfate, 1.3 g of acetic acid, 1.8 g of ammonium hydroxide, 15 mg of silver nitrate, 61 mg of potassium bromide, and 3.8 g of E-1 were added to it; and then 560 ml of an aqueous solution of 192 g of silver nitrate and 0.77 g of ammonium nitrate, and 470 ml of an aqueous solution containing potassium hexachloroiridate (III) in such an amount that the molar ratio of iridium to the finished silver halide could be $2.3\times10^{-7}$, and containing 130 g of potassium bromide were added to it in a mode of double-jet addition. Next, 0.11 g of potassium iodide was added to it to give monodispersed cubic grains of silver iodobromide having a mean grain size of 0.51 μm. A compound K mentioned below was added to the emulsion; then this was desalted; 68 g of gelatin, 0.45 g of sodium polystyrenesulfonate and 2.8 g of phenoxyethanol were added to it; this was controlled to have pH of 6.2; 1.1 mg of sodium thiosulfate and 3.1 mg of chloroauric acid were added to it to attain chemical sensitization at 62° C.; and then 0.37 g of 4-hydroxy-6-methyl-1,3,3a,7-tetrazaindene was added to it, and this was rapidly cooled for solid formation.

Compound K:

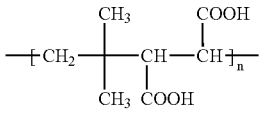

2) Preparation of Silver Iodobromide Emulsion (P):

38 g of gelatin was dissolved in one liter of $H_2O$, and kept at 55° C. in a reactor. 6.4 mg of sodium thiosulfate, 1.3 g of acetic acid, 0.80 g of ammonium hydroxide, 6.1 mg of silver nitrate, 61 mg of potassium bromide, and 3.8 g of E-1 were added to it; and then 590 ml of an aqueous solution of 190 g of silver nitrate and 0.77 g of ammonium nitrate, and 450 ml of an aqueous solution containing potassium hexachloroiridate (III) in such an amount that the molar ratio of iridium to the finished silver halide could be $9.0\times10^{-7}$, and containing 130 g of potassium bromide were added to it in a mode of double-jet addition. Next, 0.21 g of potassium iodide was added to it to give monodispersed cubic grains of silver iodobromide having a mean grain size of 0.36 μm. E-3 was added to the emulsion; then this was desalted; 75 g of gelatin, 0.16 g of potassium bromide, and 2.2 g of phenoxyethanol were added to it; this was controlled to have pH of 6.0; 7.0 mg of sodium thiosulfate and 9.7 mg of chloroauric acid were added to it to attain chemical sensitization at 60° C.; and then 0.37 g of 4-hydroxy-6-methyl-1,3,3a,7-tetrazaindene was added to it, and this was rapidly cooled for solid formation.

2. Preparation of Emulsion Coating Liquid

The emulsions O and P were mixed in a ratio of 1/2.1 in terms of mol of silver halide, and the following additives were added to the mixed emulsion to prepare a coating liquid. The amount of each chemical mentioned below is per mol of silver halide in the emulsion.

| | |
|---|---|
| Color sensitizing dye, compound K-1 | 0.075 g |
| Color sensitizing dye, compound K-2 | 0.140 g |
| Polyacrylamide (molecular weight, 40,000 to 50,000) | 10.6 g |
| 1-Phenyl-1,5-mercaptotetrazole | 0.040 g |
| Compound K-3 | 0.114 g |
| Compound K-4 | 1.76 g |
| Compound K-5 | 0.72 g |
| Poly(ethyl acrylate/methacrylic acid) latex | 30 g |
| 1,2-Bis(vinylsulfonylacetamido)ethane | 1.4 g |
| 1,3-Bis(vinylsulfonylacetamido)propane | 0.47 g |

K-1:

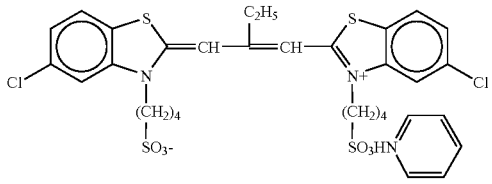

K-2:

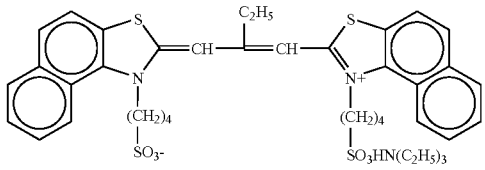

K-3

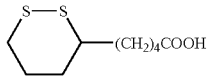

K-4

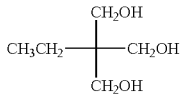

K-5

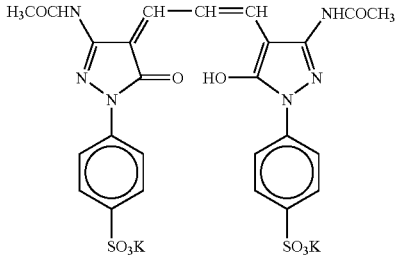

3. Preparation of Emulsion-Protective Layer Coating Liquid

A reactor was kept heated at 65° C., and the following chemicals were put into it to prepare an emulsion-protective layer coating liquid.

(Formulation of Emulsion-Protective Layer Coating Liquid)

| | |
|---|---|
| Gelatin | 100 g |
| Polyacrylamide (molecular weight, 40,000 to 50,000) | 11 g |
| Sodium polystyrenesulfonate | 3 g |
| 1,2-Bis(vinylsulfonylacetamido)ethane | 1.4 g |
| 1,3-Bis(vinylsulfonylacetamido)propane | 0.46 g |
| Fine particles of polymethyl methacrylate (mean particle size, 2.8 μm) | 2.7 g |
| $C_{16}H_{33}O—(CH_2CH_2O)_{10}—H$ | 3.8 g |

Surfactant of the Invention, or Comparative Surfactant (as in Table 2)

| | |
|---|---|
| NaOH (1 N) | 3 ml |
| Methanol | 71 ml |
| B-1 | 58 mg |

4. Preparation of Back Layer Coating Liquid

A reactor was kept heated at 65° C., and the following chemicals were put into it to prepare a back layer coating liquid.

(Formulation of Back Layer Coating Liquid)

| | |
|---|---|
| Gelatin | 100 g |
| Antihalation dye, compound K-6 (see below) | 2.2 g |
| Sodium polystyrenesulfonate | 1.4 g |
| Poly(ethyl acrylate/methacrylic acid) latex | 2.6 g |
| 1,2-Bis(vinylsulfonylacetamido)ethane | 2.3 g |
| 1,3-Bis(vinylsulfonylacetamido)propane | 0.7 g |
| B-1 | 61 mg |
| 5-4 | 0.27 g |
| Dye, compound J (as above) | 50 mg |
| Phosphoric acid | 0.81 g |
| Methanol | 59 ml |

K-6:

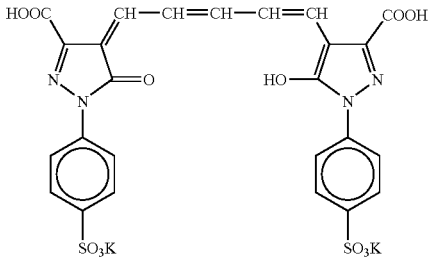

5. Preparation of Back-Protective Layer Coating Liquid

A reactor for back-protective layer coating liquid was kept heated at 65° C., and the following chemicals were put into it to prepare a back-protective layer coating liquid.

(Formulation of Back-Protective Layer Coating Liquid)

| | |
|---|---|
| Gelatin | 100 g |
| Sodium polystyrenesulfonate | 0.3 g |
| 1,2-Bis(vinylsulfonylacetamido)ethane | 1.5 g |
| 1,3-Bis(vinylsulfonylacetamido)propane | 0.48 g |
| Fine particles of polymethyl methacrylate (mean particle size, 4.7 μm) | 3.3 g |
| $C_{16}H_{33}O—(CH_2CH_2O)_{10}—H$ | 3.7 g |
| Sodium polyacrylate III-2 (molecular weight, about 100,000) | 1.9 g |

Surfactant of the Invention, or Comparative Surfactant (as in Table 2)

| | |
|---|---|
| NaOH (1 N) | 6 ml |
| Methanol | 101 ml |
| B-1 | 45 mg |

6. Formation of Photographic Materials

The back layer coating liquid and the back-protective layer coating liquid were together applied onto one side of a polyethylene terephthalate support. The gelatin coating amount in the back layer was 3.0 g/m$^2$; the gelatin coating amount in the back-protective layer was 1.5 g/m$^2$; and the total gelatin coating amount in the two layers was 4.5 g/m$^2$. Next, the emulsion coating liquid and the emulsion-protective layer coating liquid were together applied onto the other side of the support. The silver coating amount in the emulsion layer was 2.9 g/m$^2$; and the gelatin coating amount in the emulsion-protective layer was 1.2 g/m$^2$.

7. Evaluation of Samples

Thus produced, the samples Nos. 6-1 to 6-4 were evaluated in the same manner as in Example 1. The data are given in Table 2. In addition, they were evaluated in point of the anti static property thereof, according to the method mentioned below. The data are given in Table 3.

EXAMPLE 7

1. Preparation of Emulsion A 2.4 g of potassium thiocyanate, 10 mg of sodium thiosulfate 5-hydrate and 10 ml of glacial acetic acid were added to one liter of a solution of 5.0 g of potassium bromide, 4.0 g of sodium paratoluenesulfinate and 20 g of gelatin. With vigorously stirring it at 70° C., 308 ml of an aqueous solution of 117 g of silver nitrate and 305 ml of an aqueous solution of 82.4 g of potassium bromide were added to it in two times in a mode of double-jet addition taking 30 seconds for the first addition and 15 minutes for the second addition, all at a constant flow rate. 2.1 g of potassium iodide was added to it between the first addition and the second addition. Next, 7.8 ml of aqueous 25 wt. % ammonia was added to it, and this was ripened for 10 minutes. Then, 224 ml of an aqueous solution of 83.3 g of silver nitrate and 209 ml of an aqueous solution of 52.5 g of potassium bromide and 3.3 g of potassium iodide were added to it also in a mode of double-jet addition taking 14 minutes, all at a constant flow rate.

The reaction liquid was washed through ordinary flocculation; then 101 g of gelatin, 0.9 g of sodium polystyrenesulfonate (mean molecular weight, 600,000), 6.5 g of K-4, and 2.8 g of phenoxyethanol were added to and dispersed in it at 40° C.; and this was controlled to have pH of 6.5. Next, the reaction liquid was kept at 57° C.; 220 mg of 4-hydroxy-6-methyl-1,3,3a,7-tetrazaindene was added to it and ripened for 5 minutes; 270 mg of sensitizing dye A (mentioned above) was added to it, and ripened for 10 minutes; and 9 mg of sodium thiosulfate 5-hydrate, 2.1 mg of chloroauric acid, 54 mg of potassium thiocyanate and 51 mg of potassium iodide were added to it in that order, and ripened for 74 minutes. Next, 730 mg of 4-hydroxy-6-methyl-1,3,3a,7-tetrazaindene, 78 mg of sodium sulfide and 105 mg of A-5 were added to it.

In that manner, an emulsion A of amorphous grains was prepared.

2. Preparation of Emulsion B

One liter of a solution of 6.9 g of potassium thiocyanate and 8 g of low-molecular-weight gelatin (having a mean molecular weight of at most 20,000) was kept at 55° C. With vigorously stirring it, 36 ml of an aqueous solution of 4 g of silver nitrate and 39 ml of an aqueous solution of 5.9 g of potassium bromide were added to it, taking 37 seconds. Next, 128 ml of 14.5% gelatin solution was added to it; and, with heating it from 55° C. up to 72° C., 90 ml of an aqueous solution of 10 g of silver nitrate was added to it, taking 21 minutes and 30 seconds. Next, 8.5 ml of 25 wt. % aqueous ammonia, 7.8 ml of glacial acetic acid, and an aqueous solution of 1.0 g of potassium bromide were added to it; and 432 ml of an aqueous solution of 145 g of silver nitrate and an aqueous solution of potassium bromide were added to it with pBr kept at 1.9. The aqueous silver nitrate solution was added at an initial speed of 1.9 ml/min, taking 35 minutes for the complete addition. Next, an aqueous solution of 6.9 g of potassium thiocyanate was added to it, and ripened for 7 minutes. The reaction liquid was washed through ordinary flocculation; then 35 g of gelatin, 0.5 g of sodium polystyrenesulfonate (mean molecular weight, 600,000), and 1.7 g of B-1 were added to and dispersed in it at 40° C.; and this was controlled to have pH of 6.1. Next, the reaction liquid was kept at 57° C.; $3.5\times10^{-5}$ mol/mol-Ag of a thiosulfonic acid compound $T(C_2H_5SO_2SNa)$ was added to it; and fine AgI grains were added to it in an amount of 0.07 mol % relative to the overall silver amount. Next, 110 mg of 4-hydroxy-6-methyl-1,3,3a,7-tetrazaindene and 450 mg of the sensitizing dye A were added to it, and then 0.83 g of calcium chloride was added to it. Next, 1.6 g of chloroauric acid, 41 mg of potassium thiocyanate, 2.2 mg of sodium thiosulfate 5-hydrate, and 0.9 mg of the selenium sensitizer A-1 were added to it in that order, and ripened for 23 minutes; and 12.3 mg of sodium sulfite was added to it and further ripened for 30 minutes. Next, 51.3 mg of B-5 was added to it.

In that manner, a monodispersed emulsion B of tabular grains was obtained. The projected area-corresponding, mean grain size of the grains was 1.03 μm, and the aspect ratio thereof was 6.0.

3. Preparation of Upper Emulsion Layer Coating Liquid

The following chemicals were added to the emulsion A to prepare an upper emulsion layer coating liquid.

(Upper Emulsion Layer Coating Liquid 1)

| | |
|---|---|
| Emulsion A (gelatin 81 g; Ag 92 g) | 1 kg |
| Polyacrylamide (mean molecular weight, 40,000 to 50,000) | 19.8 g |
| Polymer latex (poly(ethyl acrylate/methacrylic acid) = 97/3, by weight) | 2.9 g |
| Hardener (1,2-bis(vinylsulfonylacetamido) ethane) | 1.2 g |
| 4-Hydroxy-6-methyl-1,3,3a,7-tetrazaindene | 0.20 g |
| 2,6-Bis(hydroxyamino)-4-diethylamino-1,3,5-triazine | 0.04 g |
| $C_9H_{19}C_6H_4O(CH_2CH_2O)_{50}H$ | 0.05 g |
| Distilled water to make in total | 1170 ml |

4. Preparation of Lower Emulsion Layer Coating Liquid (Lower Emulsion Layer Coating Liquid 1)

| | |
|---|---|
| Emulsion B (gelatin 50 g; Ag 110 g) | 1 kg |
| Gelatin | 57 g |
| Polyacrylamide (mean molecular weight, 40,000 to 50,000) | 11 g |
| Polymer latex (poly(ethyl acrylate/methacrylic acid) = 97/3, by weight) | 4.5 g |
| Hardener (1,2-bis(vinylsulfonylacetamido) ethane) | 1.2 g |
| 2,6-Bis(hydroxyamino)-4-diethylamino-1,3,5-triazine | 0.06 g |
| B-2 | 0.50 g |
| Potassium p-hydroquinonesulfonate | 1.0 g |
| Potassium iodide | 0.09 g |
| A-2 | 0.05 g |
| K-4 | 7.3 g |
| Sodium polystyrenesulfonate (mean molecular weight, 600,000) | 1.2 g |
| Distilled water to make in total | 1790 ml |

5. Preparation of Protective Layer Coating Liquid

| | |
|---|---|
| Gelatin | 1 kg |
| $C_{16}H_{33}O(CH_2CH_2O)_{10}H$ | 27 g |

Surfactant of the Invention, or Comparative Surfactant (as in Table 2)

| | |
|---|---|
| Polymethyl methacrylate particles (mean particle size, 2.5 μm) | 69 g |
| Proxel | 0.56 g |
| Sodium polyacrylate (mean molecular weight, 41,000) | 19 g |
| Sodium polystyrenesulfonate (mean molecular weight, 600,000) | 10.5 g |
| NaOH | 3.2 g |
| A-5 | 5.7 g |
| Methanol | 420 ml |
| Distilled water to make in total | 18.6 liters |

6. Antihalation Layer Coating Liquid (1) Preparation of Dye Dispersion L:

Dye-1, Oil-I and Oil-II of 2.5 g each were dissolved in 50 cc of ethyl acetate. This was mixed with 90 g of an aqueous 8% gelatin solution containing 1.5 g of sodium dodecylbenzenesulfonate and 0.18 g of methyl p-hydroxybenzoate, at 60° C., and then rapidly stirred in a homogenizer. After the high-speed stirring, this was degassed at 60° C. by the use of an evaporator to remove 92% by weight of ethyl acetate. As a result, a dye dispersion L having a mean particle size of 0.18 μm was obtained.

(2) Preparation of Coating Liquid:

| | |
|---|---|
| Gelatin | 1 kg |
| Polymer latex (poly(ethyl acrylate/methacrylic acid) = 97/3, by weight) | 135 g |
| Phosphoric acid | 1.23 g |
| Snowtex C | 120 g |
| Proxel | 0.5 g |
| Dye dispersion L | 271 g |
| Dye-2 | 18.1 g |
| K-6 | 12.7 g |
| Dye-4 | 13 g |
| Hardener, 1,2-bis(vinylsulfonylacetamido)ethane | 17.5 g |
| Sodium polystyrenesulfonate (mean molecular weight, 600,000) | 6 g |
| Distilled water to make in total | 13.8 liters |

Dye-2

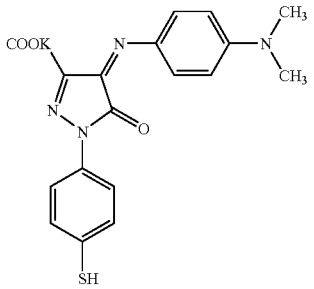

Dye-4

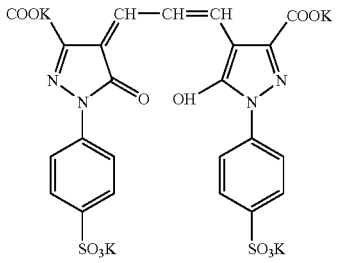

Oil-I

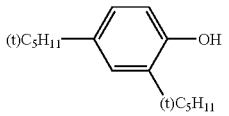

Oil-II

-continued

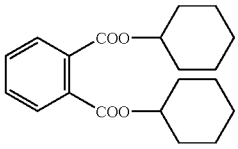

7. Back-Protective Layer Coating Liquid

| | |
|---|---|
| Gelatin | 1 kg |
| A-9 | 8.5 g |
| $C_{16}H_{33}O(CH_2CH_2O)_{10}H$ | 33 g |

Surfactant of the Invention, or Comparative Surfactant (as in Table 2)

| | |
|---|---|
| Polymethyl methacrylate particles (mean particle size, 3.7 μm) | 34 g |
| Proxel | 0.5 g |
| Sodium polyacrylate (mean molecular weight, 41,000) | 22.8 g |
| NaOH | 2.3 g |
| $C_9H_{19}C_6H_4O(CH_2)_4SO_3Na$ | 10.4 g |
| Distilled water to make in total | 10.7 liters |

8. Coating

Using the corresponding coating liquids as above, a protective layer as the uppermost layer, an emulsion A layer below it (upper emulsion layer), and an emulsion B layer further below it (lower emulsion layer) were formed in that order on one surface of a 175 μm-thick, subbed support, in a mode of simultaneous co-coating application. The gelatin amount in the protective layer was 0.6 g/m$^2$. Next, this was dried to prepare a photographic material. The silver coating amount in the upper emulsion layer was 2.9 g/m$^2$; and the silver coating amount in the lower emulsion layer was 1.5 g/m$^2$. On the other side of the support opposite to the photosensitive side thereof, an antihalation layer and a protective layer were formed using the corresponding coating liquids s above. The gelatin coating amount was 3.9 g/m$^2$ and 1.3 g/m$^2$, respectively, in the two layers.

9. Evaluation

Thus formed, the samples Nos. 7-1 to 7-4 were evaluated in the same manner as in Example 1. The data are given in Table 2. In addition, they were evaluated in point of the anti static property thereof, according to the method mentioned below. The data are given in Table 3.

TABLE 2

| | | | (mg/Gel-100 g) | | | | | | |
|---|---|---|---|---|---|---|---|---|---|
| | | Surfactant- | Non-ionic Fluorine Compound | | | Anionic Fluorine Compound | | | |
| | Sample No. | Added Layer | T-2 | FS-104 | FS-105 | T-1 | T-3 | FS-1 | FS-2 |
| Example 2 | Sample 2-1 | emulsion-protective layer | 192 | — | — | 228 | — | — | — |
| | Sample 2-2 | emulsion-protective layer | — | 192 | — | — | — | 103 | — |
| | Sample 2-3 | emulsion-protective layer | — | 192 | — | — | — | 103 | — |
| | Sample 2-4 | emulsion-protective layer | — | — | 192 | — | — | — | 103 |
| Example 3 | Sample 3-1 | emulsion-protective layer | 413 | — | — | 186 | — | — | — |
| | Sample 3-2 | emulsion-protective layer | — | 413 | — | — | — | 101 | — |
| | Sample 3-3 | emulsion-protective layer | — | — | 413 | — | — | 101 | — |
| | Sample 3-4 | emulsion-protective layer | — | 413 | — | — | — | — | 101 |
| Example 4 | Sample 4-1 | emulsion-protective layer | — | — | — | 138 | — | — | — |
| | Sample 4-2 | emulsion-protective layer | — | 21 | — | — | — | 40 | — |
| | Sample 4-3 | emulsion-protective layer | — | — | 21 | — | — | 40 | — |
| | Sample 4-4 | emulsion-protective layer | — | 21 | — | — | — | — | 40 |
| | | back-protective layer | — | 21 | — | — | — | — | 40 |
| Example 5 | Sample 5-1 | emulsion-protective layer | — | — | — | 89 | 84 | — | — |
| | | back-protective layer | — | — | — | 45 | 262 | — | — |
| | Sample 5-2 | emulsion-protective layer | — | 52 | — | — | — | 111 | — |
| | | back-protective layer | — | 52 | — | — | — | 59 | — |
| Example 6 | Sample 6-1 | emulsion-protective layer | — | — | — | 88 | 63 | — | — |
| | | back-protective layer | 69 | — | — | 79 | 46 | — | — |
| | Sample 6-2 | emulsion-protective layer | — | 32 | — | — | — | 100 | — |
| | | back-protective layer | — | 69 | — | — | — | 89 | — |
| | Sample 6-3 | emulsion-protective layer | — | 32 | — | — | — | 100 | — |
| | | back-protective layer | — | 69 | — | — | — | 89 | — |
| | Sample 6-4 | emulsion-protective layer | — | — | 32 | — | — | — | 100 |
| | | back-protective layer | — | — | 69 | — | — | — | 89 |
| Example 7 | Sample 7-1 | emulsion-protective layer | 96 | — | — | 138 | — | — | — |
| | | back-protective layer | — | — | — | — | 212 | — | — |
| | Sample 7-2 | emulsion-protective layer | — | 96 | — | — | — | 110 | — |
| | | back-protective layer | — | 35 | — | — | — | 77 | — |
| | Sample 7-3 | emulsion-protective layer | — | 96 | — | — | — | 110 | — |
| | | back-protective layer | — | 35 | — | — | — | 77 | — |
| | Sample 7-4 | emulsion-protective layer | — | — | 96 | — | — | — | 110 |
| | | back-protective layer | — | — | 35 | — | — | — | 77 |

| | (g/Gel-100 g) Anionic Non-Fluorine Compound | | | | Surface Resistivity | |
|---|---|---|---|---|---|---|
| | T-5 | T-6 | WS-17 | WS-20 | log SR | Remarks |
| Example 2 | 0.6 | — | — | — | 13.7 | comparative sample |
| | — | — | 0.6 | — | 13.2 | sample of the invention |
| | — | — | — | 0.6 | 13.1 | sample of the invention |
| | — | — | — | 0.6 | 13.2 | sample of the invention |
| Example 3 | 2.3 | — | — | — | 12.7 | comparative sample |
| | — | — | 2.3 | — | 12.1 | sample of the invention |
| | — | — | — | 2.3 | 12.2 | sample of the invention |
| | — | — | | 2.3 | 12.2 | sample of the invention |
| Example 4 | 3 | — | — | — | 14.1 | comparative sample |
| | — | — | — | 3 | 13.5 | sample of the invention |
| | — | — | — | 3 | 13.3 | sample of the invention |
| | — | — | 3 | — | 13.5 | sample of the invention |
| | — | — | 3 | — | 13.4 | |
| Example 5 | 1.5 | — | — | — | 13.8 | comparative sample |
| | 1.8 | — | — | | 13.9 | |
| | — | — | — | 1.5 | 13.4 | comparative sample |
| | — | — | — | 1.8 | 13.3 | |
| Example 6 | 1.6 | — | — | — | 13.8 | comparative sample |
| | 2.1 | — | — | — | 13.9 | sample of the Invention |
| | — | — | 1.6 | — | 13.5 | sample of the invention |
| | — | — | 2.1 | — | 13.5 | sample of the invention |
| | — | — | — | 1.6 | 13.3 | comparative sample |
| | — | — | — | 2.1 | 13.4 | |
| | — | — | — | 1.6 | 13.4 | sample of the invention |
| | — | — | — | 2.1 | 13.3 | |
| Example 7 | 1.6 | — | — | — | 13.8 | comparative sample |
| | — | 1 | — | — | 13.9 | sample of the invention |
| | — | — | 1.6 | — | 13.6 | sample of the invention |
| | — | — | 1 | — | 13.5 | sample of the invention |
| | — | — | — | 1.6 | 13.4 | comparative sample |
| | — | — | — | 1 | 13.3 | |
| | — | — | — | 1.6 | 13.5 | sample of the invention |
| | — | — | — | 1 | 13.4 | |

The numerals in Table 2 indicate the amount of the non ionic fluorine compound, the anionic fluorine compound and the anionic non-fluorine compound used in these Examples, relative to 100 g of gelatin. In Table 2, T-1, T-2 and T-5 are the same as those in Table 1. T-3 and T-6 are mentioned below.

T-3: $C_8F_{17}SO_3K$

T-6: $C_9H_{19}—C_6H_4—O(CH_2)_4SO_3Na$

From the data in Table 2, it is understood that the surface resistivity of the samples of the invention does not increase even after 2 months from their production.

(Evaluation of Static Resistance)

A screen, HI-SCREEN B-2 (by Fuji Photo Film) was stuck to the inner surface of a cassette Fuji EC CASSETTEN (by Fuji Photo Film), and the screen was rubbed with fibers at 25° C. and 25% RH. Then, a cleaner for X-ray paper, Fuji AS Cleaner (by Fuji Photo Film) was applied to it, and this was dewaxed with acetone and chloroform to such a degree that the electrostatic potential voltage on the screen surface, measured with a static potentiometer, M2 (trade name by Shishido Electrostatic), could fall between 3 and 4 kV. The sample of the invention or the comparative sample was set in the thus pre-treated cassette. This was left in a dark room at 25° C. and 25% RH, and then the sample was taken out of the cassette. Using an automatic developing machine (CEPROS-M2 by Fuji Photo Film, with a developer CED-1 by Fuji Photo Film), the sample was developed at 34° C. for 25 seconds, taking 90 seconds for total processing. A fixer CEF-1 (by Fuji Photo Film) was used for fixation, and tap water was used for rinsing.

Thus processed, the samples were checked for static marks, and were evaluated for static resistance according to the following criteria:

Evaluation:

5: No static mark found.

4: Some static marks found, but a few.

3: Some static marks found to an average degree.

2: Many static marks found.

1: Many and extreme static marks found.

The data of the static resistance test of the samples of Examples 2 to 7 are given in Table 3 below.

TABLE 3

| Example No. | Sample No. | Evaluation of Static Resistance | Remarks |
|---|---|---|---|
| Example 2 | Sample 2-1 | 3 | comparative sample |
| | Sample 2-2 | 4 | sample of the invention |
| | Sample 2-3 | 5 | sample of the invention |
| | Sample 2-4 | 4 | sample of the invention |
| Example 3 | Sample 3-1 | 4 | comparative sample |
| | Sample 3-2 | 5 | sample of the invention |
| | Sample 3-3 | 5 | sample of the invention |
| | Sample 3-4 | 4 | sample of the invention |
| Example 4 | Sample 4-1 | 2 | comparative sample |
| | Sample 4-2 | 4 | sample of the invention |
| | Sample 4-3 | 4 | sample of the invention |
| | Sample 4-4 | 3 | sample of the invention |
| Example 5 | Sample 5-1 | 4 | comparative sample |
| | Sample 5-2 | 5 | sample of the invention |
| Example 6 | Sample 6-1 | 3 | comparative sample |
| | Sample 6-2 | 4 | sample of the invention |
| | Sample 6-3 | 5 | sample of the invention |
| | Sample 6-4 | 4 | sample of the invention |
| Example 7 | Sample 7-1 | 3 | comparative sample |
| | Sample 7-2 | 4 | sample of the invention |
| | Sample 7-3 | 4 | sample of the invention |
| | Sample 7-4 | 4 | sample of the invention |

From these data, it is understood that the compounds of the invention are fluorine compounds of good metabolism, and even though their amount is small, they are well effective for making silver halide photographic material have good anti static properties.

EXAMPLE 8

In Example 7, the constitutive components of the surface-protective layer and the back-protective layer were selected from the compounds mentioned below with no limitation on their selection, and their amount was determined within the range mentioned below also with no limitation on their determination. The same good results as above were obtained.

<Composition of Surface-Protective Layer>

| | |
|---|---|
| A-5 | 0.5 to 5.0 mg/m$^2$ |
| A-6 | 0 to 50 mg/m$^2$ |
| A-10 | 0.2 to 5.0 mg/m$^2$ |
| B-1 | 0.2 to 5.0 mg/m$^2$ |
| B-5 | 1.0 to 100 mg/m$^2$ |
| D-2 | 25 to 200 mg/m$^2$ |
| NaOH | 0.7 to 10 mg/m$^2$ |
| FS-104 or FS-105 of formula (1) | 0 to 30 mg/m$^2$ |
| FS-1 or ES-7 of formula (2) | 0 to 10 mg/m$^2$ |
| WS-17 or WS-20 of formula (3) | 0 to 50 mg/m$^2$ |
| Dextran | 100 to 500 mg/m$^2$ |
| Sodium polystyrenesulfonate | 0.4 go 40 mg/m$^2$ |
| $C_{17}H_{35}CON(CH_3)CH_2SO_3Na$ | 3.0 to 30 mg/m$^2$ |
| $C_nH_{2n+1}$-Ph-$SO_3Na$ (n = 10 to 16) | 5.0 to 30 mg/m$^2$ |
| $C_{16}H_{33}O\ (CH_2CH_2O)_{10}H$ | 0 to 50 mg/m$^2$ |
| $C_9H_{19}C_6H_4O(CH_2)_4SO_3Na$ | 0 to 50 mg/m$^2$ |
| U-1 | 0.5 to 10 mg/m$^2$ |
| U-2 | 0.2 to 5.0 mg/m$^2$ |
| U-3 | 2.5 to 100 mg/m$^2$ |
| U-4 | 1.0 to 20 mg/m$^2$ |
| U-5 | 100 to 400 mg/m$^2$ |
| U-6 | 30 to 300 mg/m$^2$ |
| Sodium acetate | 1.0 to 100 mg/m$^2$ |
| $SiO_2$ | 100 to 800 mg/m$^2$ |
| $KNO_3$ | 30 to 300 mg/m$^2$ |
| $H_3PO_4$ | 7.5 to 75 mg/m$^2$ |

U-1

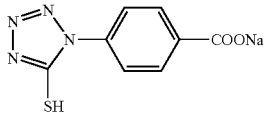

U-2

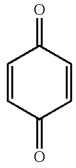

U-3

-continued

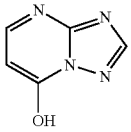

U-4

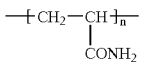

Mw = 4~50000

U-5

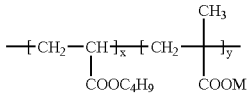

x/y = 60/40 (weight ratio)
M: H/Na = 20/80 (molar ratio)

When a novel, short-chain fluoroalkyl group-having non ionic surfactant of the invention is added to a silver halide photographic material along with a fluorine-containing anionic surfactant and a hydrocarbon-type surfactant thereto, then the silver halide photographic material containing them has good static resistance and good anti static properties.

The present disclosure relates to the subject matter contained in Japanese Patent Application No. 166617/2003 filed on Jun. 11, 2003, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A silver halide photographic material having, on a support thereof, one or more layers including a photosensitive silver halide emulsion layer, which contains at least one non ionic fluorine compound of the following formula (1) and at least one anionic fluorine compound of the following formula (2):

$$C_4F_9—CH_2CH(OH)CH_2—(OCH_2CH_2)_m—OC_nH_{2+1} \quad (1)$$

wherein m indicates from 15 to 40; n indicates from 8 to 24;

(2)

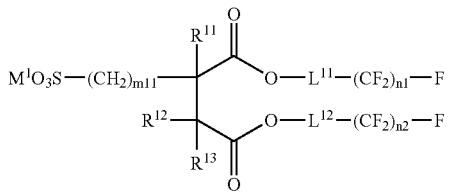

wherein $R^{11}$, $R^{12}$ and $R^{13}$ each independently represent a hydrogen atom or a substitute; n1 and n2 each independently indicate an integer of from 4 to 8; $L^{11}$ and $L^{12}$ each independently represent a substituted or unsubstituted alkylene group, a substituted or unsubstituted alkyleneoxy group, or a divalent linking group constructed by combining any of these; m11 indicates 0 or 1; and $M^1$ represents a cation.

2. The silver halide photographic material of claim 1, which contains at least one anionic hydrocarbon compound of the following formula (3), at least one non ionic fluorine compound of formula (1), and at least one anionic fluorine compound of formula (2)

(3)

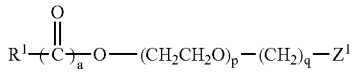

wherein $R^1$ represents an alkyl or alkenyl group having from 6 to 25 carbon atoms; q indicates from 2 to 4; p indicates from 0 to 30; a indicates 0 or 1; $Z^1$ represents $OSO_3M$ or $SO_3M$; and M represents a cation.

3. The silver halide photographic material of claim 1, which has a non-photosensitive hydrophilic colloid layer as the outermost layer thereof, and in which the outermost layer contains at least one non ionic fluorine compound of formula (1) and at least one anionic fluorine compound of formula (2).

4. The silver halide photographic material of claim 2, which has a non-photosensitive hydrophilic colloid layer as the outermost layer thereof, and in which the outermost layer contains at least one non ionic fluorine compound of formula (1), at least one anionic fluorine compound of formula (2), and at least one anionic hydrocarbon compound of formula (3).

5. The silver halide photographic material of claim 2, which has a non-photosensitive hydrophilic colloid layer as the outermost layer on both sides of the support thereof, and in which at least one outermost layer contains at least one non ionic fluorine compound of formula (1), at least one anionic fluorine compound of formula (2), and at least one anionic hydrocarbon compound of formula (3).

6. The silver halide photographic material of claim 2, which has a non-photosensitive hydrophilic colloid layer as the outermost layer on both sides of the support thereof, and in which both outermost layers contain at least one non ionic fluorine compound of formula (1), at least one anionic fluorine compound of formula (2), and at least one anionic hydrocarbon compound of formula (3).

7. The silver halide photographic material of claim 1, wherein the non ionic fluorine compound is a compound of the following formula (1-A):

$$C_4F_9—CH_2CH(OH)CH_2—(OCH_2CH_2)_{ma}—OC_{na}H_{2na+1}$$

wherein ma indicates from 20 to 40; na indicates from 12 to 18;

8. The silver halide photographic material of claim 7, wherein ma in formula (1-A) indicates from 25 to 40.

9. The silver halide photographic material of claim 7, wherein na in formula (1-A) indicates from 12 to 16.

10. The silver halide photographic material of claim 1, wherein the anionic fluorine compound is a compound of the following formula (2-A):

(2-A)

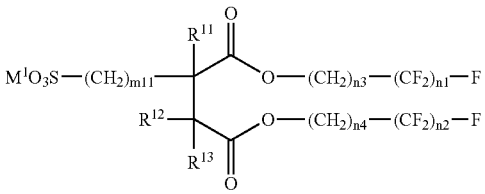

wherein $R^{11}$, $R^{12}$ and $R^{13}$ each independently represent a hydrogen atom or a substitute; n1 and n2 each independently indicate an integer of from 4 to 8; n3 and n4 each independently indicate an integer of from 1 to 6; m11 indicates 0 or 1; and $M^1$ represents a cation.

11. The silver halide photographic material of claim 1, wherein the anionic fluorine compound is a compound of the following formula (2-B):

(2-B)

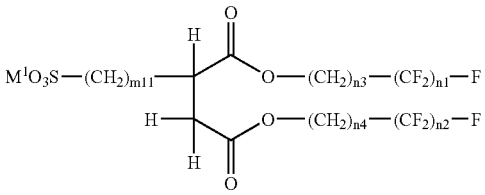

wherein n1 and n2 each independently indicate an integer of from 4 to 8; n3 and n4 each independently indicate an integer of from 1 to 6; m11 indicates 0 or 1; and $M^1$ represents a cation.

12. The silver halide photographic material of claim 1, wherein the anionic fluorine compound is a compound of the following formula (2-C):

(2-C)

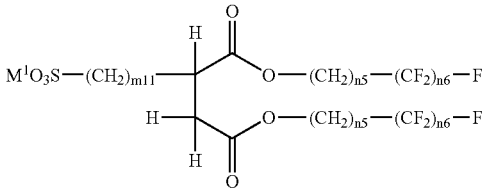

wherein n5 indicates 2 or 3; n6 indicates an integer of from 4 to 6; m11 indicates 0 or 1; and $M^1$ represents a cation.

13. The silver halide photographic material of claim 12, wherein n5 in the formula (2-C) represents 2.

14. The silver halide photographic material of claim 12, wherein n6 in the formula (2-C) represents 4.

15. The silver halide photographic material of claim 2, wherein the anionic hydrocarbon compound is a compound of the following formula (3-A):

$$R^{1a}—O—(CH_2CH_2O)_{p1}—(CH_2)_{q1}—SOM_3 \quad (3\text{-}A)$$

wherein $R^{1a}$ represents an alkyl group having from 8 to 18 carbon atoms; p1 indicates from 0 to 5; q1 indicates from 2 to 4; and M represents a cation.

16. The silver halide photographic material of claim 15, wherein $R^{1a}$ in the formula (3-A) represents an alkyl group having from 10 to 14 carbon atoms.

17. The silver halide photographic material of claim 15, wherein p1 in the formula (3-A) indicates from 1 to 3.

18. The silver halide photographic material of claim 15, wherein q1 in the formula (3-A) represents 4.

19. The silver halide photographic material of claim 3, wherein the outermost layer contains gelatin and the non ionic fluorine compound in an amount of from 0.003 to 1% by mass relative to the solid content of the gelatin.

20. The silver halide photographic material of claim 3, wherein the outermost layer contains gelatin and the anionic fluorine compound in an amount of from 0.003 to 1% by mass relative to the solid content of the gelatin.

* * * * *